US008528761B2

(12) United States Patent
Yarro et al.

(10) Patent No.: US 8,528,761 B2
(45) Date of Patent: Sep. 10, 2013

(54) LAUNCHABLE BEVERAGE CONTAINER CONCEPTS

(75) Inventors: Justin C. Yarro, Provo, UT (US); Ralph J. Yarro, Provo, UT (US); Matt Redding, Edison, WA (US); Daniel Child, Pleasant Grove, UT (US)

(73) Assignee: ThinkAtomic, Inc., Orem, UT (US)

( * ) Notice: Subject to any disclaimer, the term of this patent is extended or adjusted under 35 U.S.C. 154(b) by 61 days.

(21) Appl. No.: 11/856,015

(22) Filed: Sep. 15, 2007

(65) Prior Publication Data

US 2010/0102023 A1 Apr. 29, 2010

Related U.S. Application Data

(60) Provisional application No. 60/825,898, filed on Sep. 15, 2006.

(51) Int. Cl.
*B65D 23/00* (2006.01)
*B65D 81/30* (2006.01)
*A63H 27/00* (2006.01)

(52) U.S. Cl.
USPC ..... 215/382; 215/379; 215/386; 215/400; 446/61; 446/75; 446/76

(58) Field of Classification Search
USPC ..... 215/379, 382, 386, 400, DIG. 1; 446/61, 75, 76, 77, 231
See application file for complete search history.

(56) References Cited

U.S. PATENT DOCUMENTS 582,765 A * 5/1897 Rebholz ..... 215/386
D183,564 S 9/1958 Erstad
3,955,715 A * 5/1976 Topor ..... 222/143
4,153,667 A 5/1979 Brady et al.
4,254,079 A 3/1981 Agrawal
4,254,080 A 3/1981 Agrawal
4,380,526 A 4/1983 Agrawal
4,522,779 A 6/1985 Jabarin
4,603,066 A 7/1986 Jabarin
4,749,092 A * 6/1988 Sugiura et al. ..... 215/381
4,778,068 A * 10/1988 Kohus ..... 215/11.1
4,871,507 A 10/1989 Ajmera
4,880,126 A 11/1989 Anderson
4,882,119 A 11/1989 Ajmera
5,002,199 A * 3/1991 Frahm ..... 220/670

(Continued)

OTHER PUBLICATIONS

Anonymous, Blow Molding, Jun. 19, 2010, pp. 1-8 of eight pages, Wikipedia, United States.

*Primary Examiner* — Anthony Stashick
*Assistant Examiner* — Madison L Poos
(74) *Attorney, Agent, or Firm* — Austin Rapp & Hardman

(57) ABSTRACT

Disclosed herein are beverage bottles that incorporate one or more of: fins that are molded in, attached individually or in a finned section; a base section adapting a finned bottle for transport in a track or conveyor of bottling machinery; aerodynamic noses and nosecones, attachable to the neck or bottom of a bottle, optionally holding an object, prize or additive, also optionally acting as a stand for the bottle; a production sleeve permitting transport through a track or conveyor; noses, fins and finned sections that are reversible; a crush zone for absorbing impact energy; a pump for providing thrust or structural pressure, some incorporated into the bottle product and others provided externally, and for launchable products, nozzles and mechanisms for containing thrust pressure. Detailed information on various example embodiments of the inventions are provided in the Detailed Description below, and the inventions are defined by the appended claims.

20 Claims, 29 Drawing Sheets

(56) References Cited

U.S. PATENT DOCUMENTS

| | | | | | |
|---|---|---|---|---|---|
| D317,184 | S | | 5/1991 | Moomaw et al. | |
| D318,301 | S | | 7/1991 | Murphy | |
| 5,041,042 | A | | 8/1991 | Stein | |
| 5,056,659 | A | | 10/1991 | Howes et al. | |
| 5,080,623 | A | | 1/1992 | Stein | |
| 5,188,557 | A | * | 2/1993 | Brown | 446/212 |
| 5,352,402 | A | | 10/1994 | Orimoto et al. | |
| D359,766 | S | | 6/1995 | Bueno | |
| 5,439,103 | A | | 8/1995 | Howes | |
| 5,540,879 | A | | 7/1996 | Orimoto et al. | |
| 5,611,988 | A | | 3/1997 | Mahajan | |
| 5,647,930 | A | | 7/1997 | Bright | |
| 5,714,569 | A | | 2/1998 | Imaizumi et al. | |
| 5,785,278 | A | | 7/1998 | Bejtlich, III | |
| 5,792,563 | A | | 8/1998 | Mahajan | |
| 5,795,598 | A | | 8/1998 | Wohlgemuth et al. | |
| 5,823,391 | A | * | 10/1998 | Klauke et al. | 222/94 |
| 5,839,940 | A | | 11/1998 | Ensmenger | |
| D405,474 | S | | 2/1999 | Trondson | |
| 5,881,706 | A | | 3/1999 | Carson | |
| 5,951,938 | A | | 9/1999 | Takeuchi et al. | |
| D417,896 | S | | 12/1999 | Eisner | |
| D425,137 | S | | 5/2000 | Eisner | |
| D430,906 | S | | 9/2000 | Eisner | |
| 6,116,888 | A | | 9/2000 | Johnston et al. | |
| 6,138,402 | A | | 10/2000 | Wotton | |
| 6,176,755 | B1 | | 1/2001 | Bye et al. | |
| D438,914 | S | | 3/2001 | O'Rourke et al. | |
| D448,305 | S | | 9/2001 | Warner et al. | |
| 6,315,629 | B1 | | 11/2001 | Jones | |
| 6,347,623 | B1 | | 2/2002 | Kownacki et al. | |
| 6,488,556 | B2 | * | 12/2002 | Galomb | 446/73 |
| 6,514,451 | B1 | | 2/2003 | Boyd et al. | |
| 6,568,170 | B1 | | 5/2003 | Rives | |
| 6,601,574 | B1 | | 8/2003 | Cole | |
| D502,512 | S | | 3/2005 | Carbonero | |
| 6,887,422 | B2 | | 5/2005 | Wandyez | |
| D509,261 | S | | 9/2005 | Tebbe | |
| 6,957,526 | B1 | | 10/2005 | Lin | |
| 6,968,966 | B2 | * | 11/2005 | Gregory | 215/252 |
| 6,998,091 | B2 | | 2/2006 | Iizuka et al. | |
| 7,600,655 | B2 | | 10/2009 | Agrawal et al. | |
| 8,308,007 | B2 | * | 11/2012 | Mast et al. | 215/381 |
| 2002/0074347 | A1 | | 6/2002 | Murray et al. | |
| 2003/0006210 | A1 | | 1/2003 | Iizuka et al. | |
| 2003/0029827 | A1 | | 2/2003 | Renz | |
| 2003/0148003 | A1 | | 8/2003 | Wright | |
| 2003/0162157 | A1 | | 8/2003 | Yun | |
| 2004/0013030 | A1 | | 1/2004 | Renz | |
| 2004/0058829 | A1 | | 3/2004 | Hei et al. | |
| 2004/0097650 | A1 | | 5/2004 | Ogawa et al. | |
| 2004/0118103 | A1 | | 6/2004 | Nagashima | |
| 2004/0172921 | A1 | | 9/2004 | Shimazaki | |
| 2004/0197756 | A1 | | 10/2004 | Yun | |
| 2004/0208960 | A1 | | 10/2004 | Marshall | |
| 2005/0009440 | A1 | | 1/2005 | Foster et al. | |
| 2005/0014439 | A1 | | 1/2005 | Erickson et al. | |
| 2005/0056608 | A1 | | 3/2005 | Nesin | |
| 2005/0268985 | A1 | | 12/2005 | Litto | |
| 2006/0011090 | A1 | | 1/2006 | Vasel et al. | |

* cited by examiner

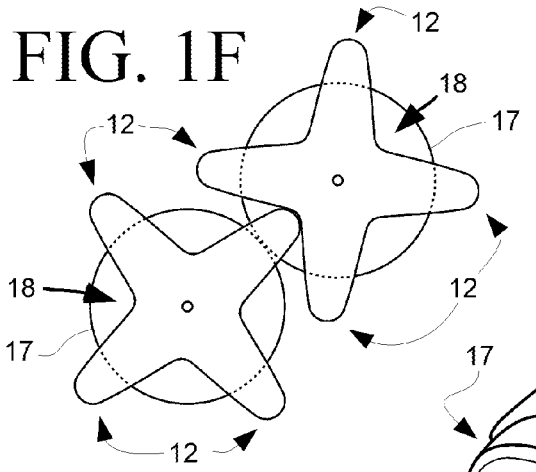
FIG. 1F
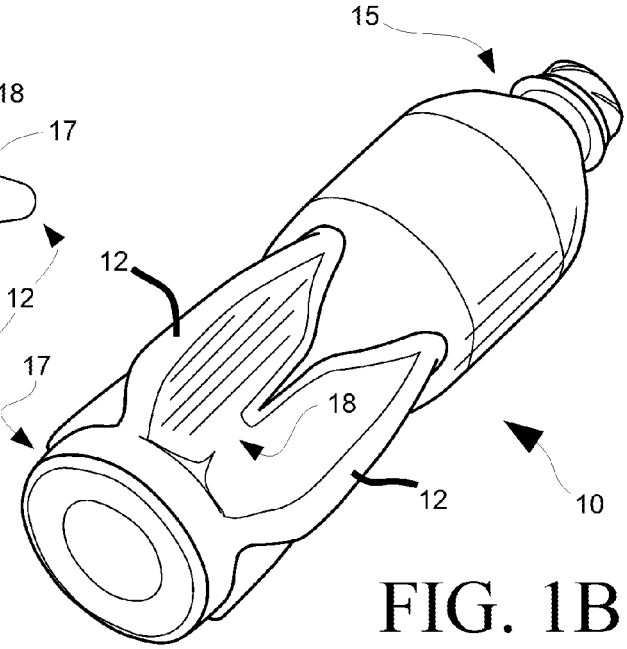
FIG. 1B
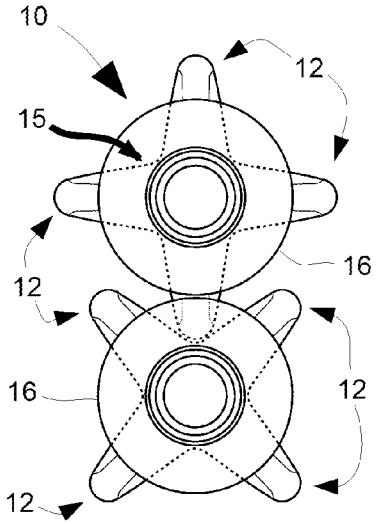
FIG. 1A
FIG. 1C
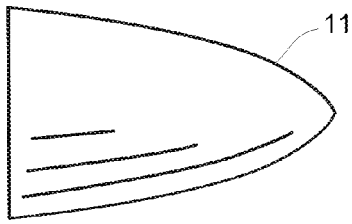
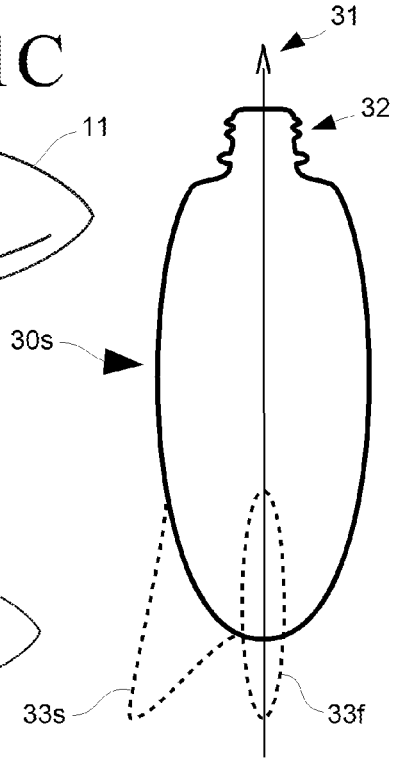
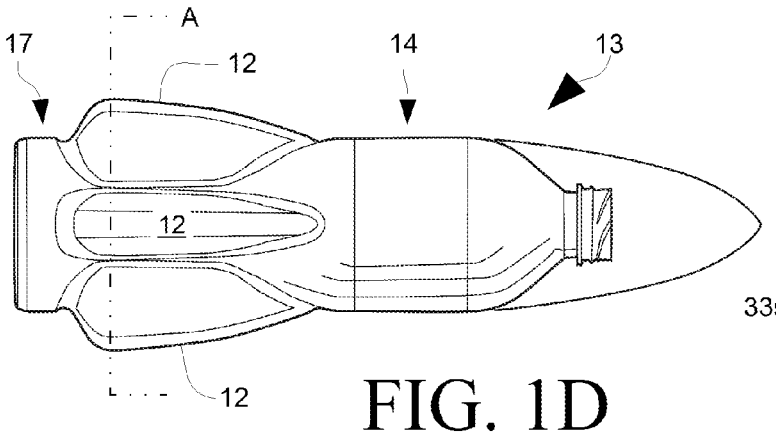
FIG. 1D
FIG. 1E

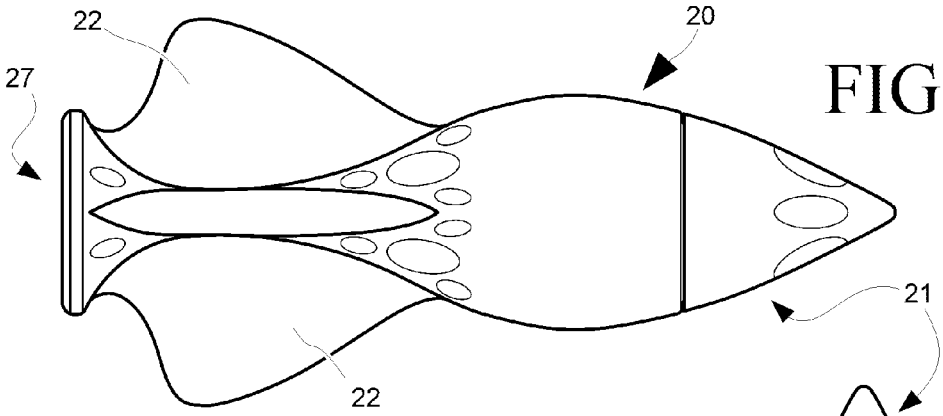
FIG. 2A
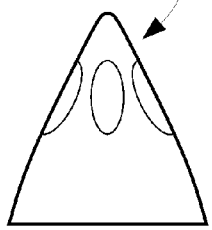
FIG. 2C
FIG. 2B
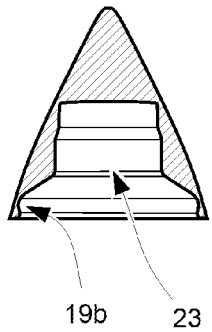
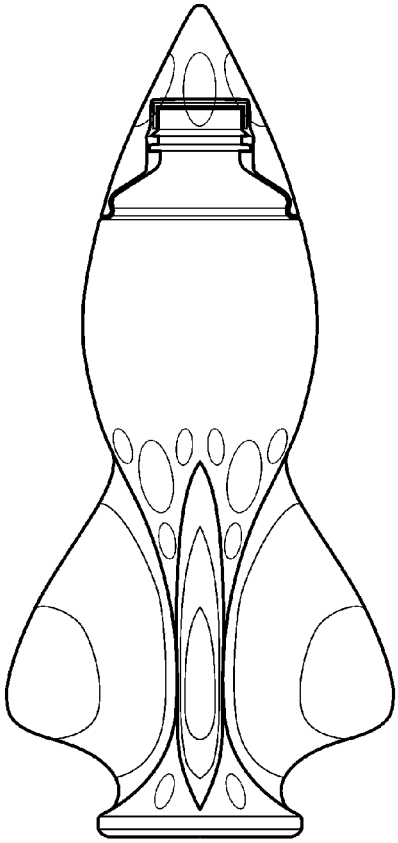
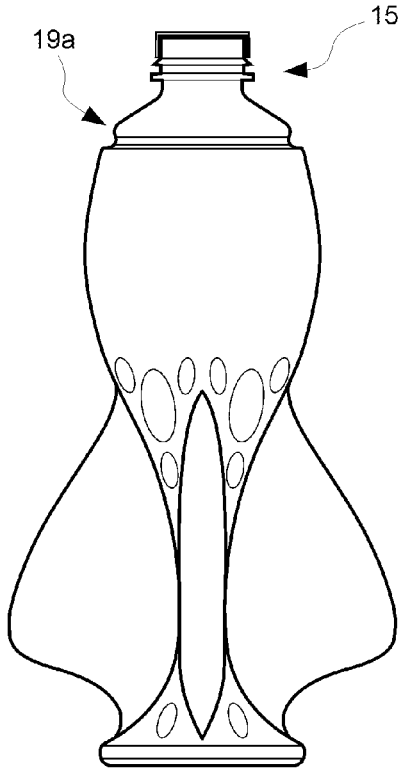
FIG. 2D FIG. 3A
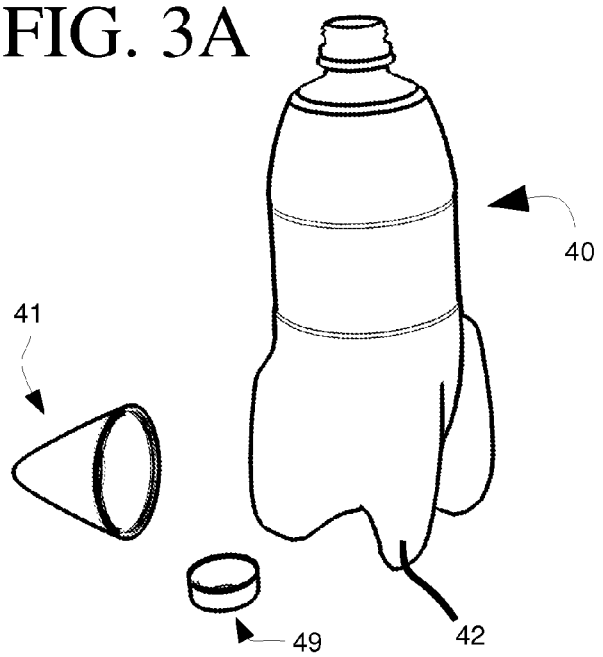
FIG. 3D
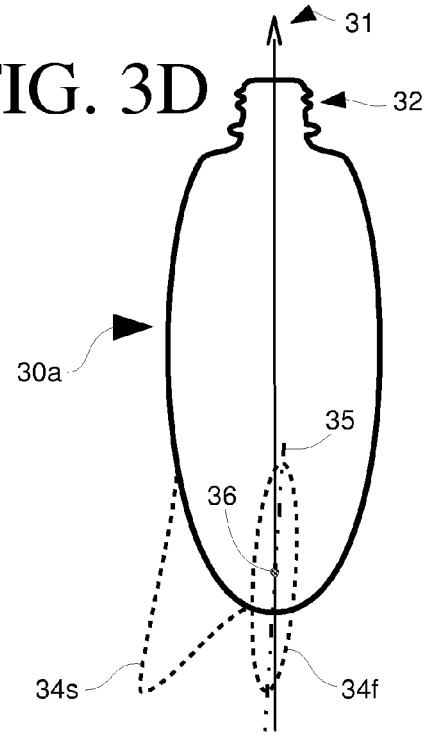
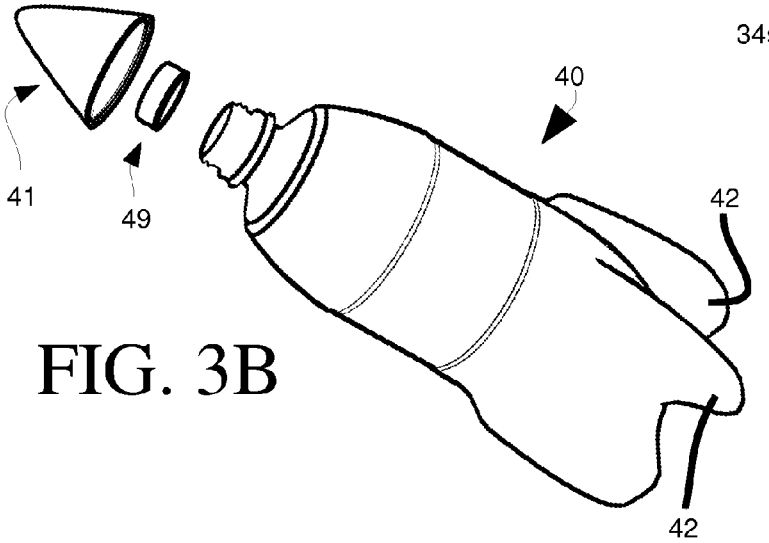
FIG. 3B
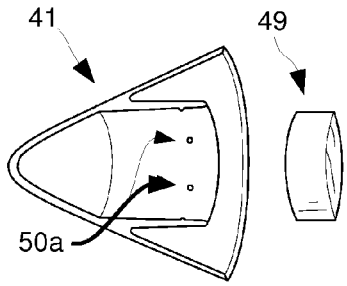
FIG. 3E
FIG. 3C
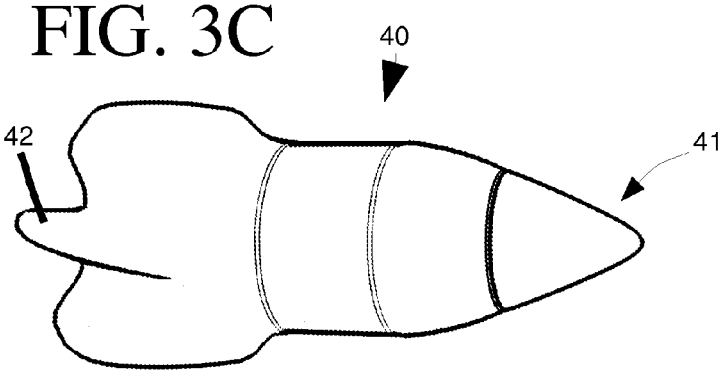
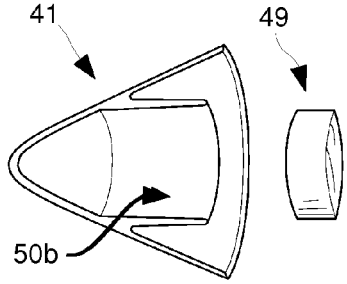
FIG. 3F

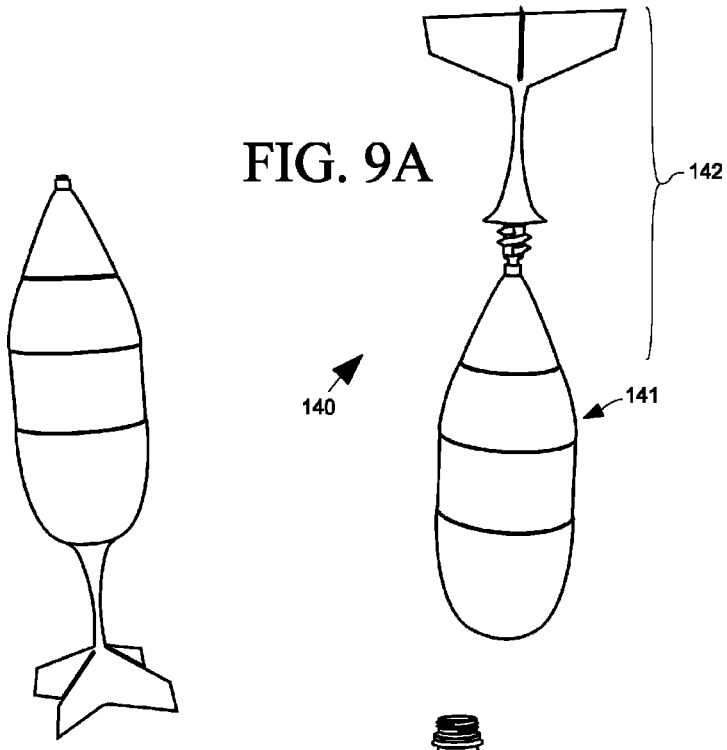
FIG. 9A
FIG. 9B
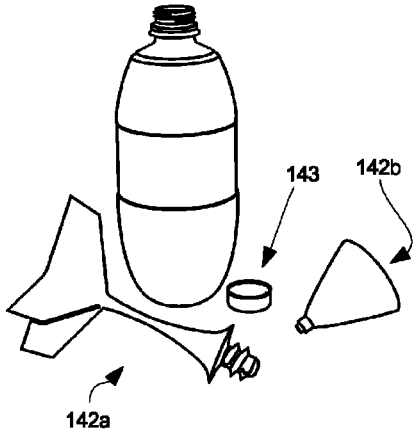
FIG. 9C

FIG. 11B
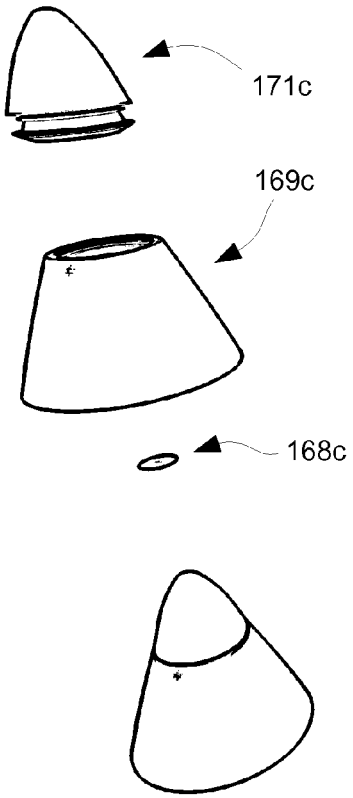
FIG. 11A
FIG. 12B
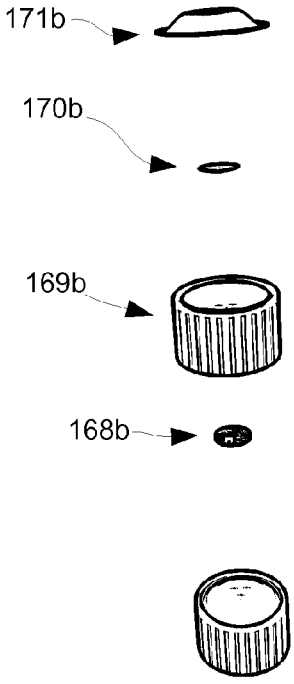
FIG. 12A
FIG. 13B
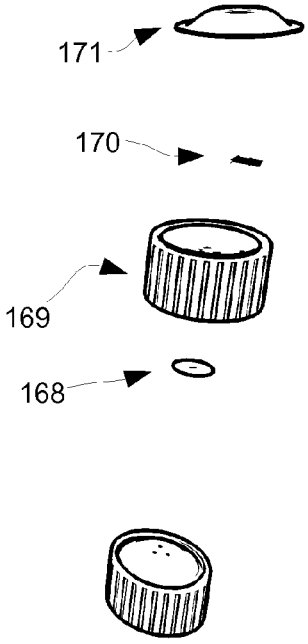
FIG. 13A

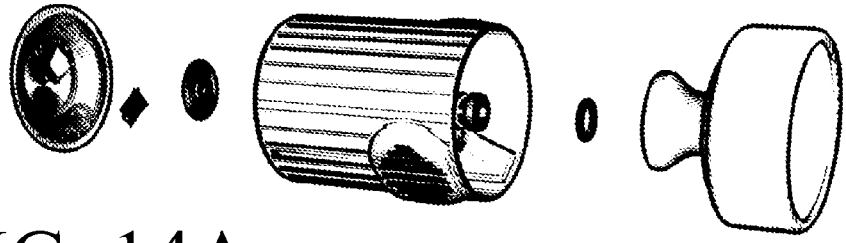
FIG. 14A
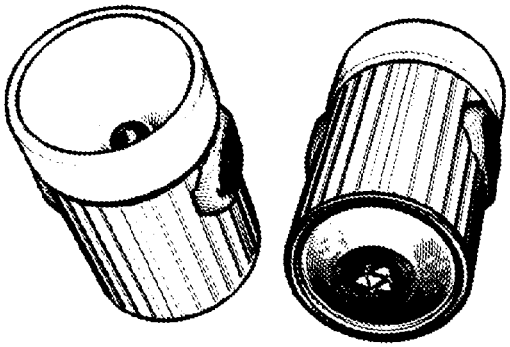
FIG. 14B
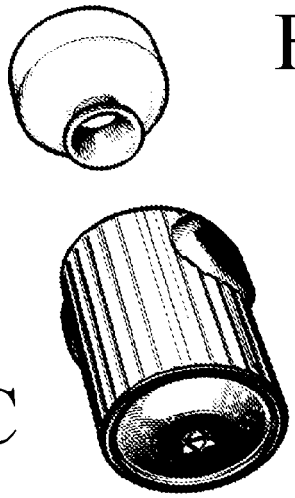
FIG. 14C
FIG. 14D
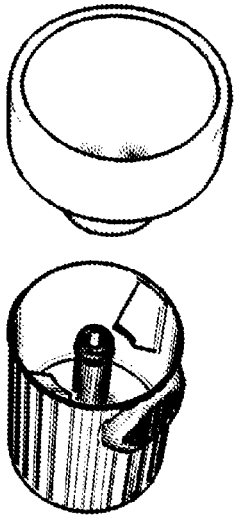

FIG. 15A
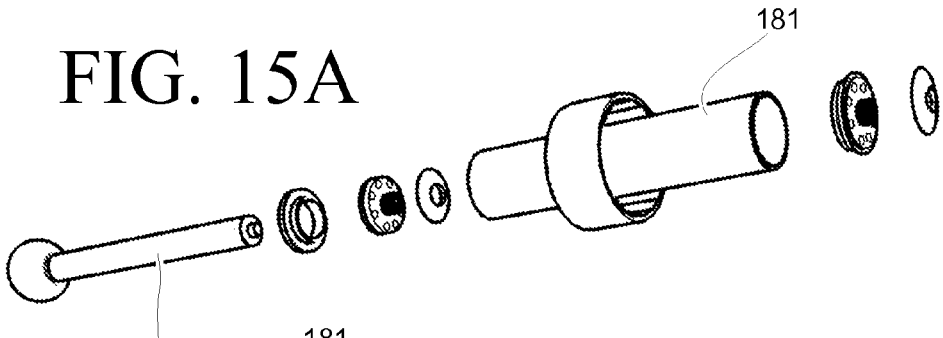
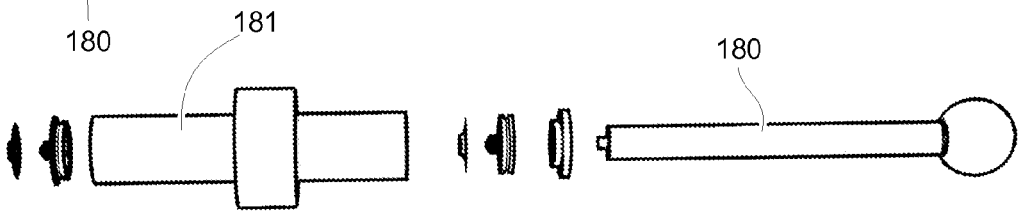
FIG. 15B
FIG. 15E
FIG. 15D
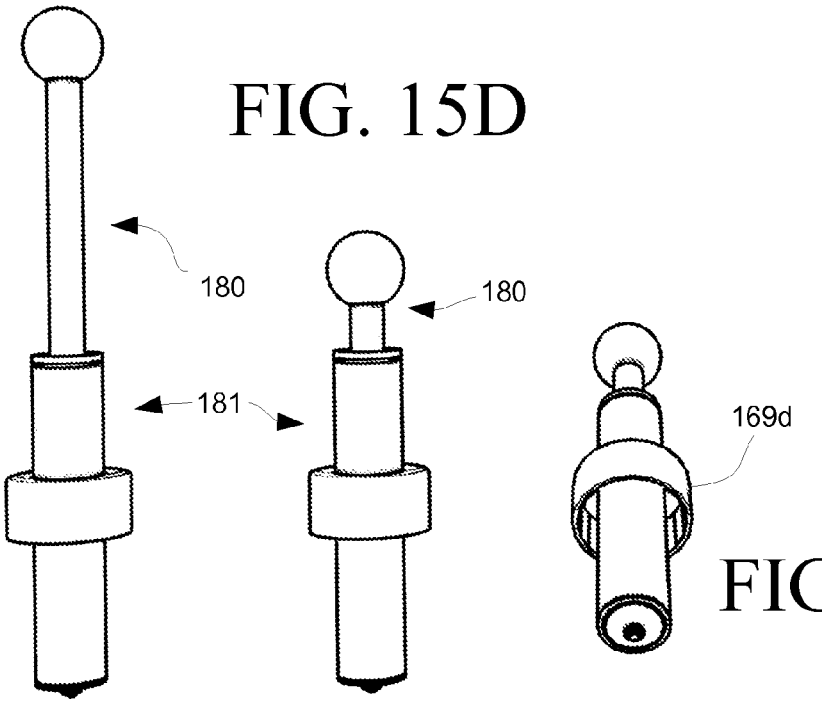
FIG. 15C

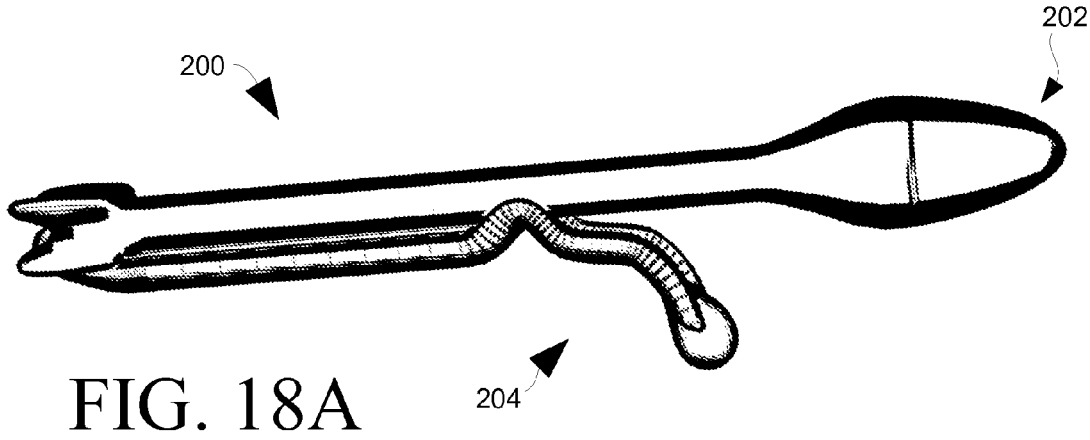
FIG. 18A
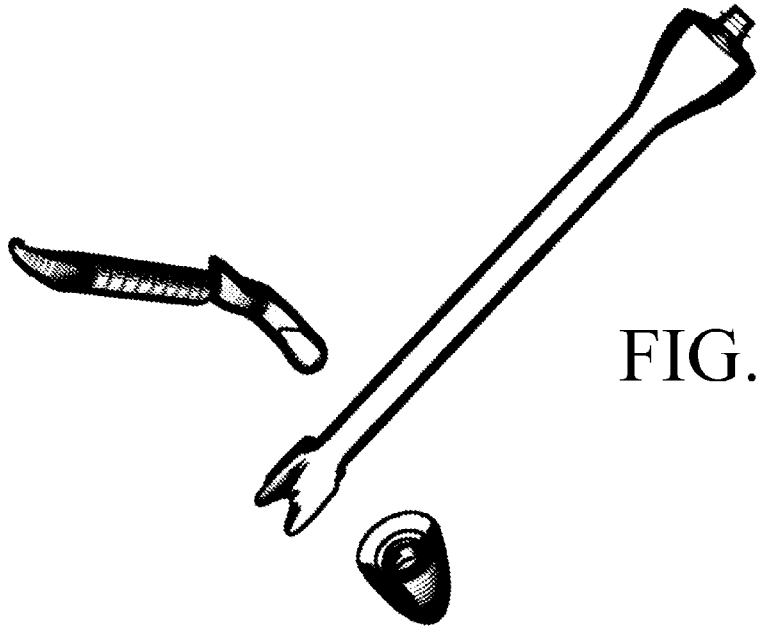
FIG. 18B
FIG. 18C
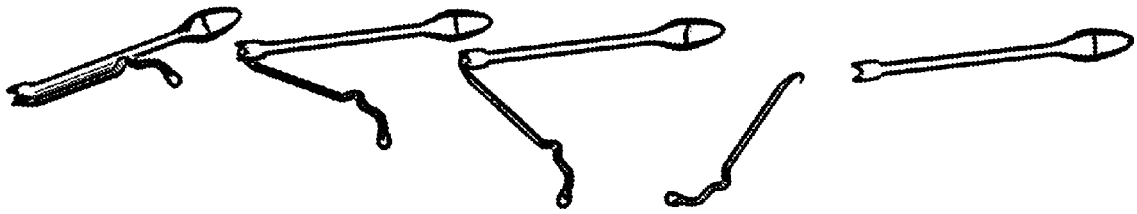

FIG. 19A
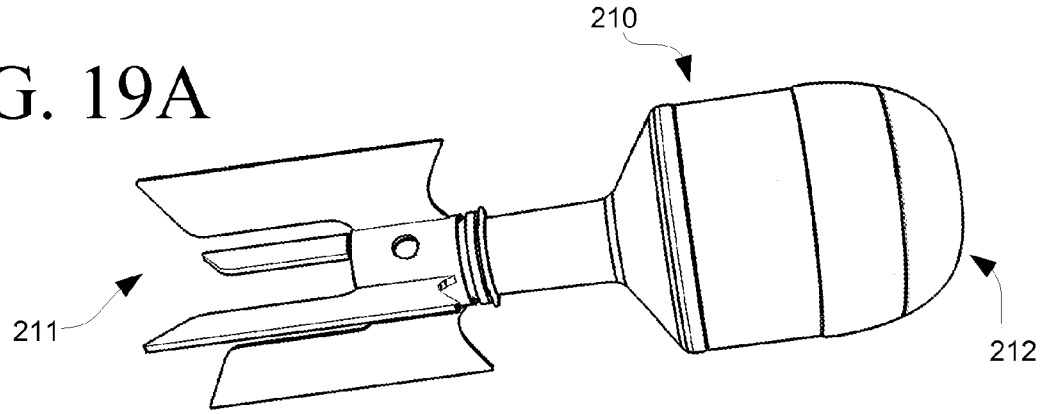
FIG. 19B
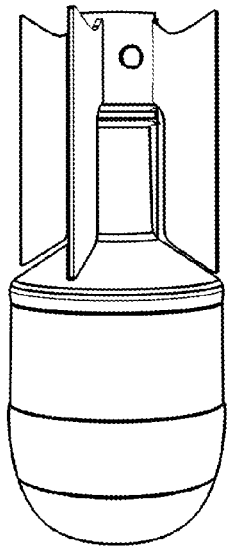
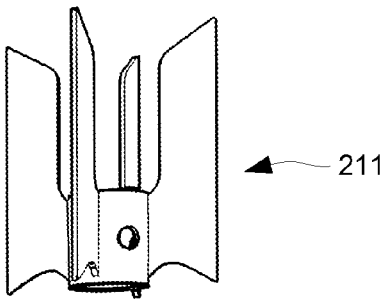
FIG. 19C
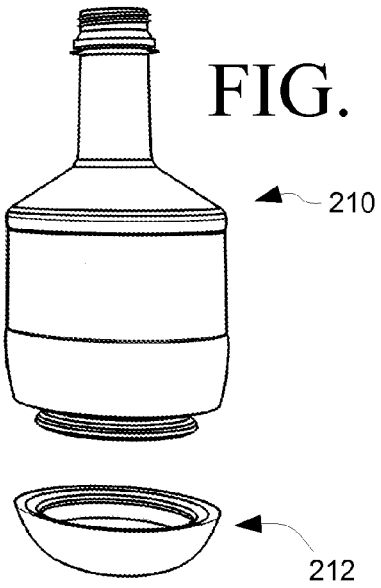
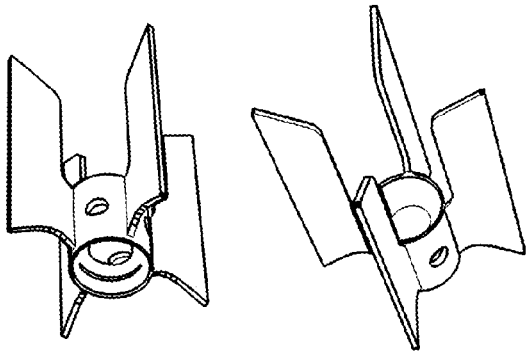
FIG. 19D

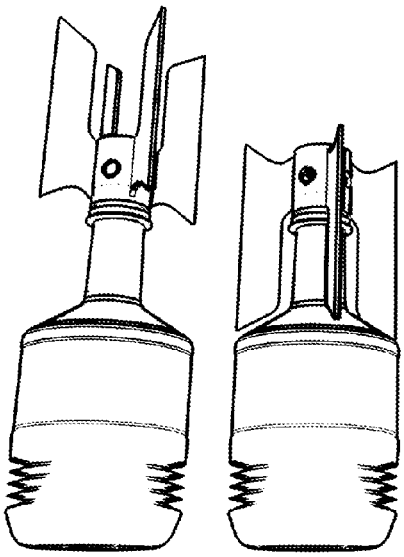
FIG. 20A
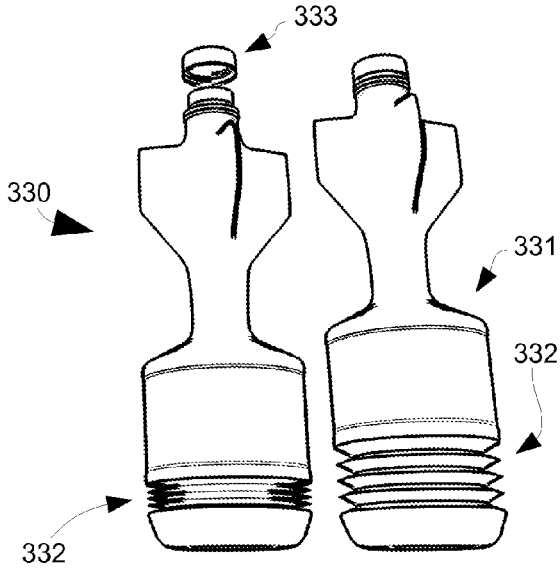
FIG. 20B
FIG. 20C
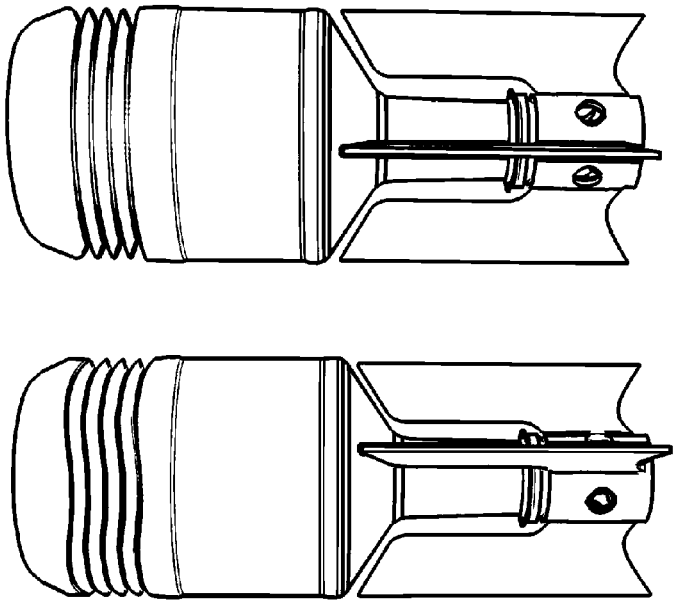
FIG. 20D

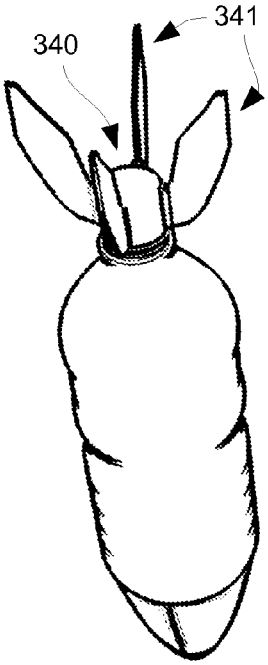
FIG. 22C
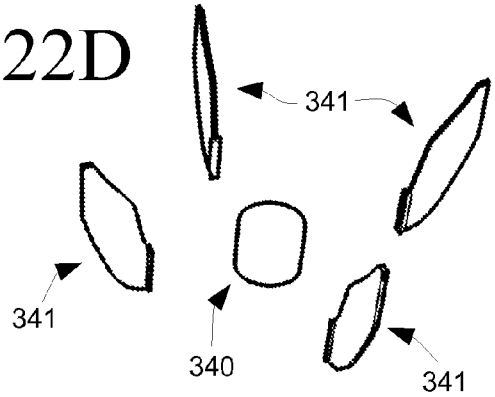
FIG. 22D
FIG. 29A
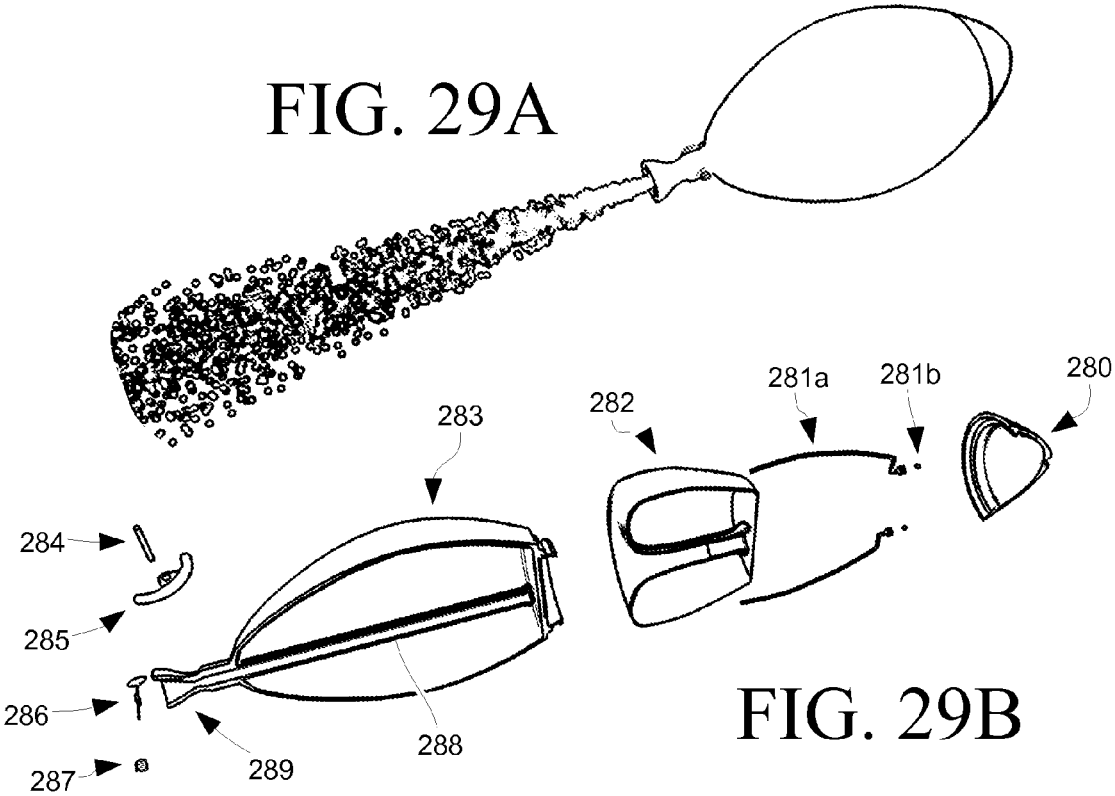
FIG. 29B

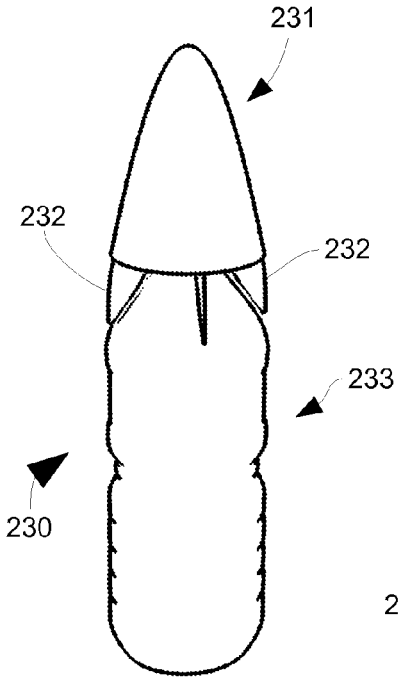
FIG. 24A
FIG. 24B
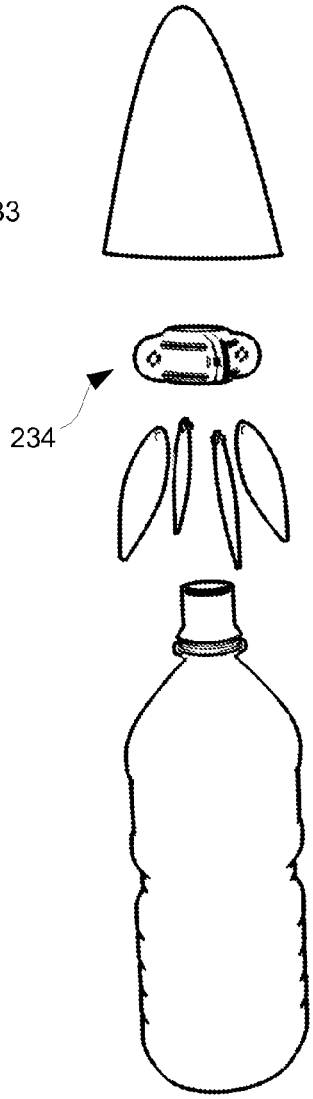
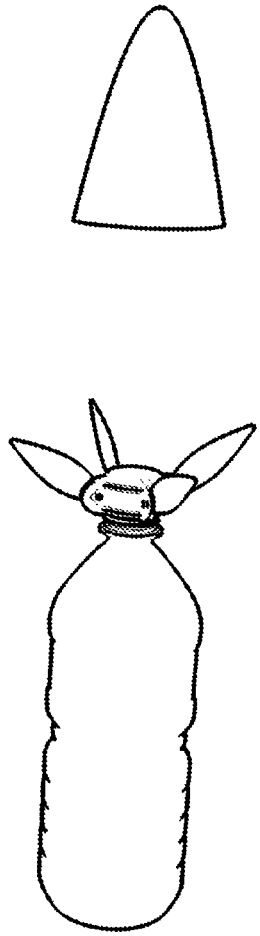
FIG. 24C
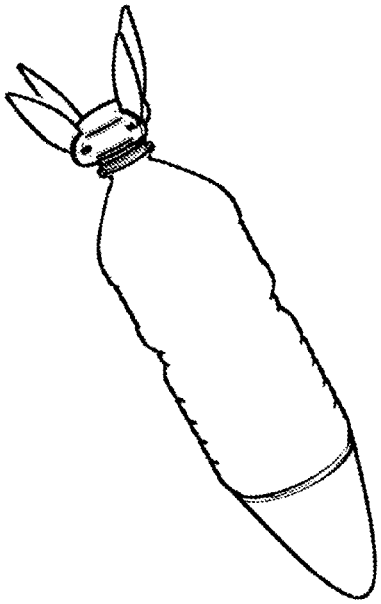
FIG. 24D

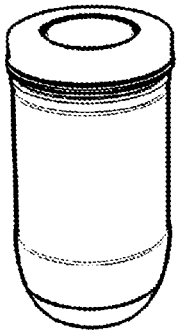
FIG. 26A
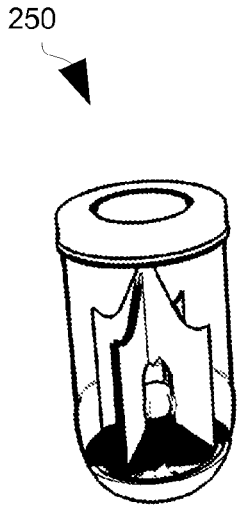
FIG. 26B
FIG. 26C
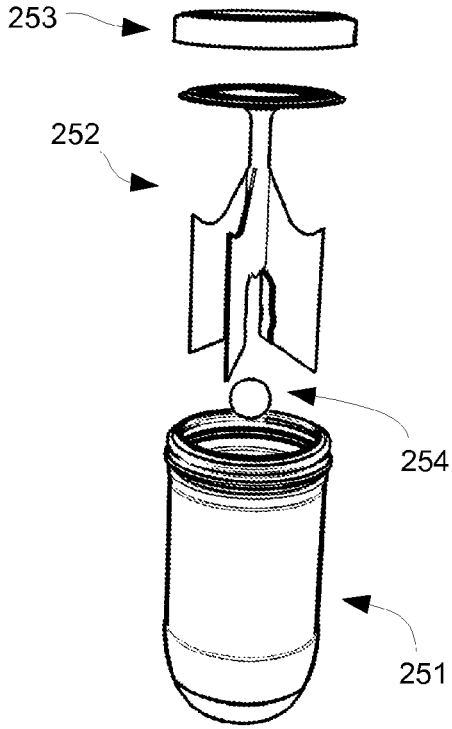
FIG. 26D
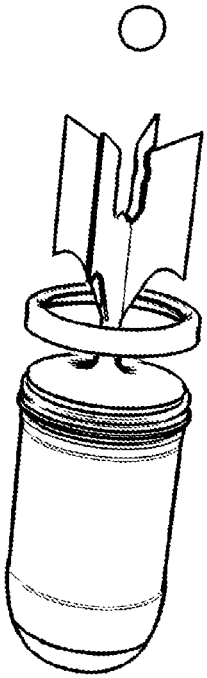
FIG. 26E
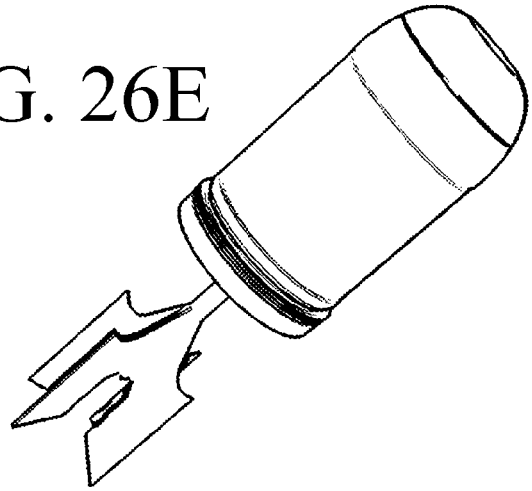

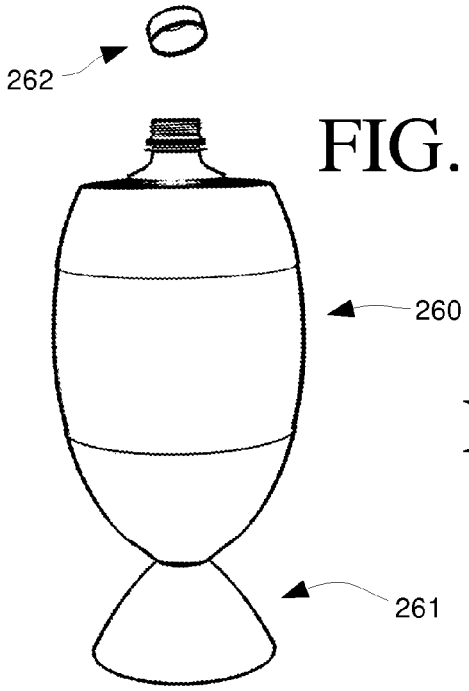
FIG. 27A
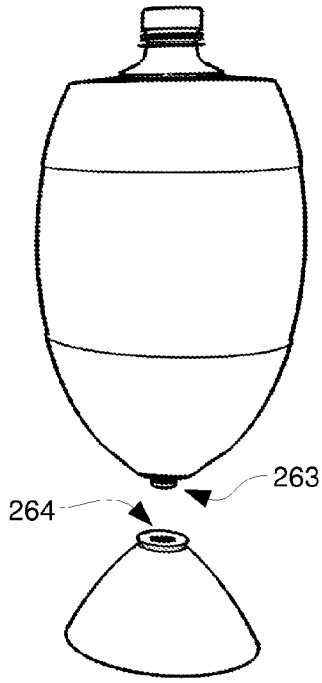
FIG. 27B
FIG. 27C
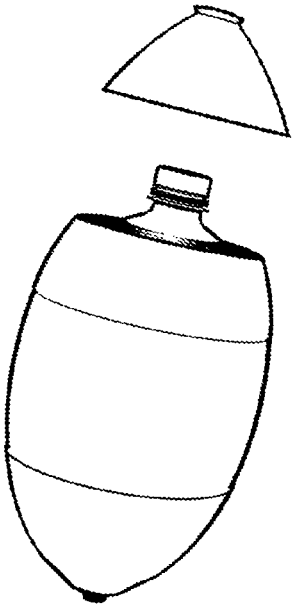
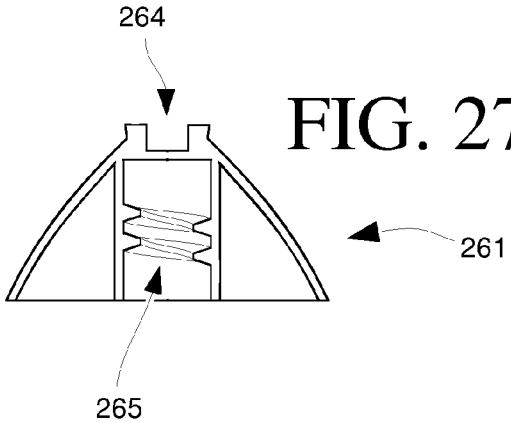
FIG. 27E
FIG. 27D
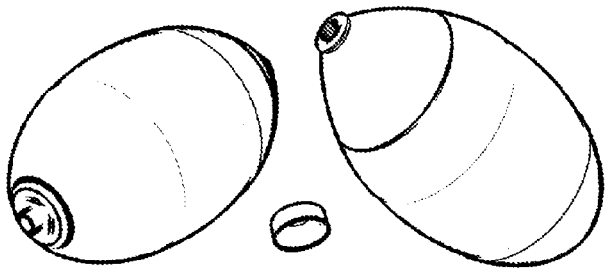

FIG. 28A
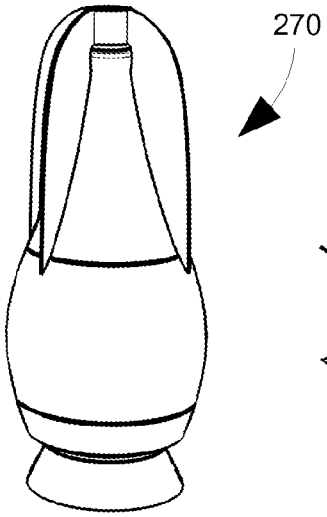
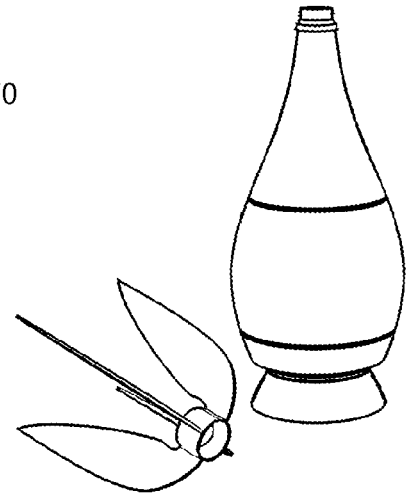
FIG. 28B
FIG. 28C
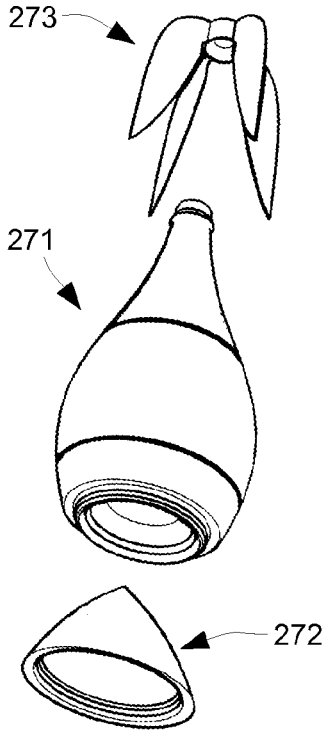
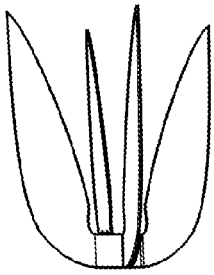
FIG. 28D
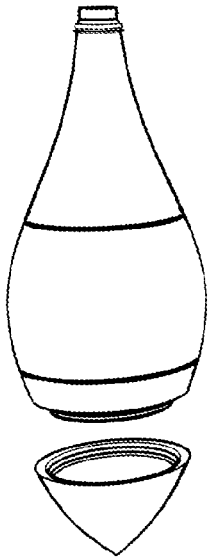
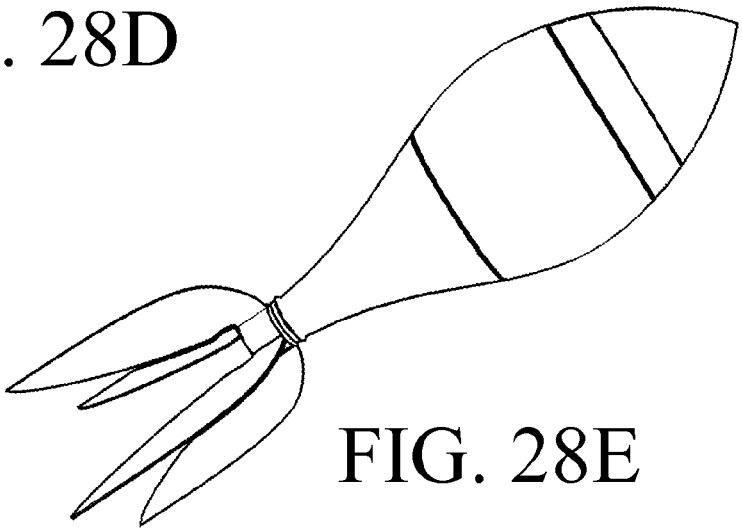
FIG. 28E FIG. 30A
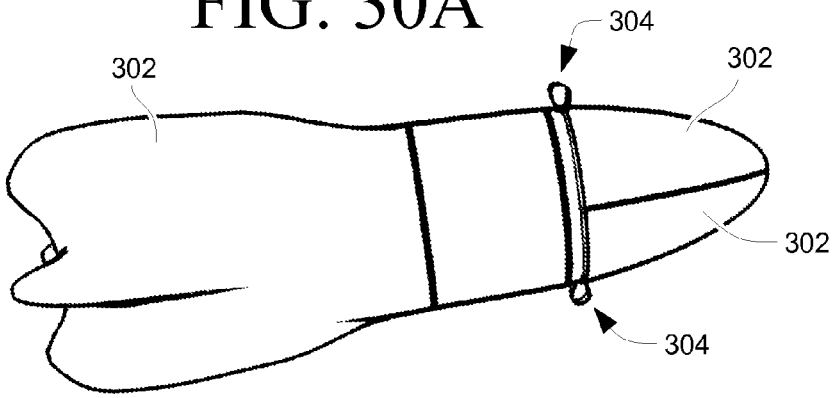
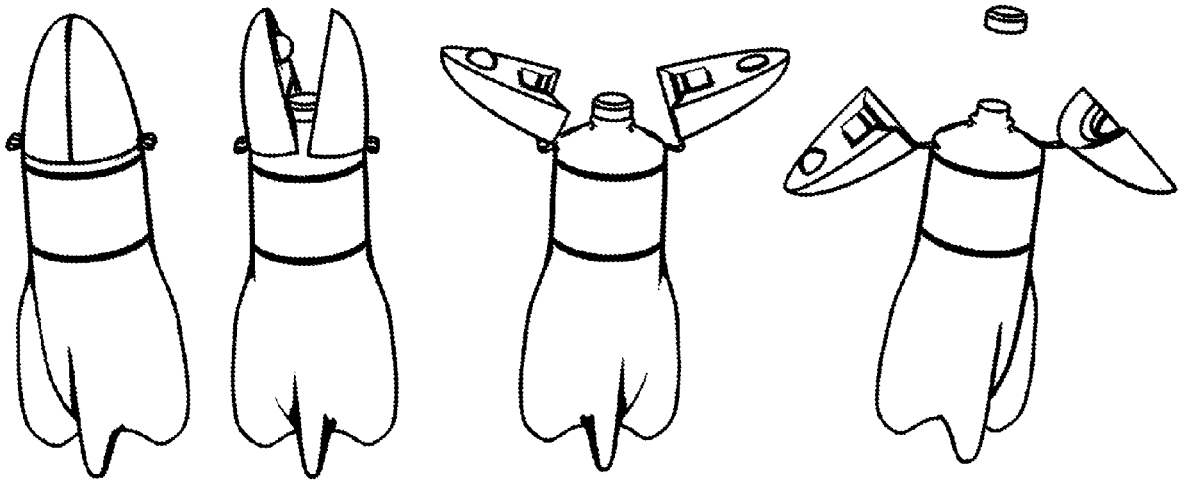
FIG. 30B FIG. 32A
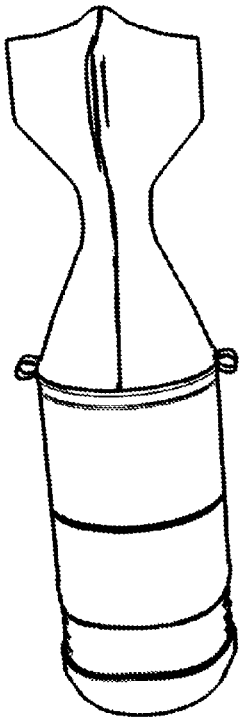
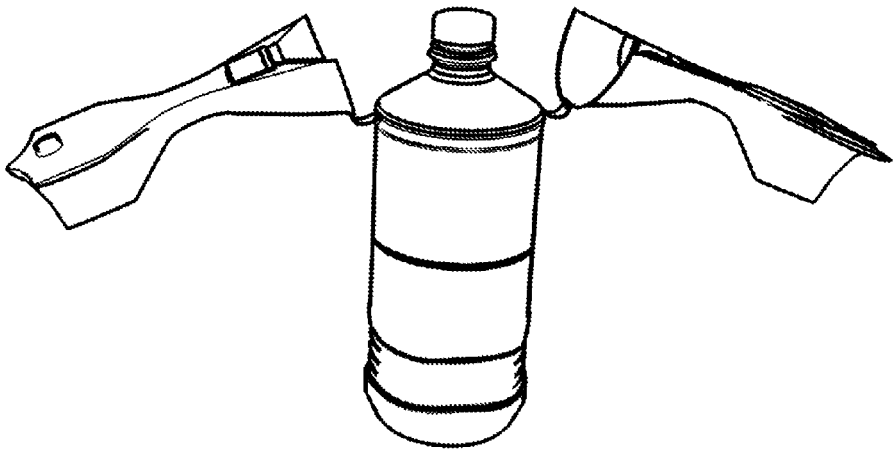
FIG. 32B

LAUNCHABLE BEVERAGE CONTAINER CONCEPTS

CROSS REFERENCE TO RELATED APPLICATIONS

This Application claims the benefit of U.S. Provisional Application No. 60/825,989 filed on Sep. 15, 2007 which is hereby incorporated by reference in its entirety.

BACKGROUND

The claimed systems and methods relate generally to throwable, tossable or launchable beverage bottles and containers, and more particularly to a beverage bottle that incorporates one or more of the following briefly described features: fins that are molded in, attached individually or in a finned section; a base section adapting a finned bottle to be transported in a track or conveyor of beverage or bottling machinery; noses or nosecones providing improved aerodynamic properties, attachable to the neck or bottom of a bottle or other location, optionally holding an object, prize or additive, also optionally acting as a stand for the bottle; a production sleeve permitting transport through a track or conveyor; noses, fins and finned sections that are reversible; a crush zone for absorbing impact energy; an optional pump for providing thrust or structural pressure, some of which pumps are incorporated into the bottle product and others provided externally, and for launchable products, nozzles and mechanisms for containing thrust pressure.

BRIEF SUMMARY

Disclosed herein are aerodynamic beverage bottles that incorporate one or more of: fins that are molded in, attached individually or in a finned section; a base section adapting a finned bottle for transport in a track or conveyor of bottling machinery; aerodynamic noses and nosecones, attachable to the neck or bottom of a bottle or other location, optionally holding an object, prize or additive, also optionally acting as a stand for the bottle; a production sleeve permitting transport through a track or conveyor; noses, fins and finned sections that are reversible; a crush zone for absorbing impact energy; a pump for providing thrust or structural pressure, some incorporated into the bottle product and others provided externally, and for launchable products, nozzles and mechanisms for containing thrust pressure. Detailed information on various example embodiments of the inventions are provided in the Detailed Description below, and the inventions are defined by the appended claims.

BRIEF DESCRIPTION OF THE DRAWINGS

FIG. 1A depicts the top of two stackable and fitted containers of a first "missile" type of launchable beverage container product.

FIG. 1B depicts the side and bottom of the container of the "missile" container product.

FIG. 1C depicts the nosecone of the "missile" container product.

FIG. 1D depicts an assembled "missile" type of launchable beverage container product.

FIG. 1E depicts the geometry of an exemplary throwable container having straight fins.

FIG. 1F depicts in cross-section two stackable and fitted containers the "missile" beverage container product.

FIG. 2A depicts the assembly of a second "tear" type of launchable beverage container product.

FIG. 2B depicts an assembly of the "tear" product with a transparent nosecone.

FIG. 2C shows the nosecone of the "tear" product in cross-section.

FIG. 2D illustrates the assembly of the body and nosecone of the "tear" product.

FIG. 3A shows the unassembled parts of a third "spinner" type of launchable beverage container product.

FIG. 3B illustrates the assembly of the nosecone, cap and body of the "spinner" product.

FIG. 3C depicts the "spinner" product after assembly.

FIG. 3D depicts the geometry of an exemplary throwable container having angled fins.

FIG. 3E shows an exemplary nosecone fittable to a cap using detents.

FIG. 3F shows an exemplary nosecone fittable to a cap utilizing a slip- or friction-fit.

FIG. 9A depicts a first assembly of a "spy bottle" type of launchable beverage container product having a nose and finned section formed on a tree.

FIG. 9B depicts a second assembly in launchable condition of a "spy bottle" product with nose and finned section separated.

FIG. 9C depicts the unassembled parts of the "spy bottle" product with nose and finned section separated.

FIG. 11A depicts a nosecone-pump combination for a pressurizable, launchable beverage container product.

FIG. 11B illustrates the assembly of the nosecone-pump of FIG. 11A.

FIG. 12A depicts a nozzle-coupling pump with a first check-valve configuration for a pressurizable, launchable beverage container product.

FIG. 12B illustrates the assembly of the nosecone-pump of FIG. 12A.

FIG. 13A depicts a nozzle-coupling pump with a second check-valve configuration for a pressurizable, launchable beverage container product.

FIG. 13B illustrates the assembly of the nosecone-pump of FIG. 13A.

FIG. 14A is an assembly view of the pump/release mechanism and nozzle of FIG. 10D.

FIG. 14B shows a view of a coupled nozzle and pump assembly of the pump and nozzle of FIG. 14A.

FIG. 14C illustrates the coupling between the nozzle and pump assembly of the pump and nozzle of FIG. 14A as viewed from the pump.

FIG. 14D illustrates the coupling between the nozzle and pump assembly of the pump and nozzle of FIG. 14A as viewed from the nozzle.

FIG. 15A illustrates the assembly of a piston-type of pump that is couplable to a pressurizable, launchable beverage container product.

FIG. 15B illustrates the assembly of the piston-type pump of FIG. 15A from a side-on view.

FIG. 15C shows the assembled piston-type of pump of FIG. 15A in a depressed state.

FIG. 15D shows the assembled piston-type of pump of FIG. 15A in a depressed state from a side-angle.

FIG. 15E shows the assembled piston-type of pump of FIG. 15A in a extended state.

FIG. 18A depicts a "spear" type of launchable beverage container product coupled to an atlatl-type launcher.

FIG. 18B shows the unassembled components of the "spear" product of FIG. 18A.

FIG. 18C illustrates the launching operation of the "spear" product of FIG. 18A.

FIG. 19A depicts another type of launchable beverage container product having a reversible finned section and a base-coupling nose in a launchable state.

FIG. 19B depicts the product of FIG. 19A in a storage or shipment state.

FIG. 19C shows the disassembly of the product of FIG. 19A.

FIG. 19D shows the finned section of the product of FIG. 19A in two views.

FIG. 20A depicts another type of launchable beverage container product having a reversible finned section and a crush zone.

FIG. 20B depicts another type of launchable beverage container product having fins molded into the body and a crush zone.

FIG. 20C is a larger view of the product of FIG. 20A.

FIG. 20D is a product of the type of FIG. 20A with a waved crush zone.

FIG. 22B depicts another type of launchable beverage container product having a slotted cap for receiving fins.

FIG. 24A depicts another type of launchable beverage container product in a shippable condition having hinged fins on a cap.

FIG. 24B depicts the product of FIG. 24A after disassembly from a shippable condition.

FIG. 24C illustrates the reconfiguration of the product of FIG. 24A into a launchable condition.

FIG. 24D shows the product of FIG. 24A in a launchable condition as viewed from the side.

FIG. 26A shows an "interior containment" type of launchable beverage container product in a shippable/storable condition.

FIG. 26B shows the product of FIG. 26A in a shippable/storable condition in cutaway view.

FIG. 26C illustrates the disassembly of the interior containment product of FIG. 26A from a shippable/storable condition.

FIG. 26D illustrates the assembly of the interior containment product of FIG. 26A into a launchable condition.

FIG. 26E depicts the interior containment product of FIG. 26A in a launchable condition.

FIG. 27A shows a "nose-base" type of launchable beverage container product in a standable/drinkable condition.

FIG. 27B shows the stand mating of the nose-base to the bottle of the product of FIG. 27A.

FIG. 27C shows the closure mating of the nose-base to the bottle of the product of FIG. 27A.

FIG. 27D shows the nose-base product of FIG. 27A in alternate configuration.

FIG. 27E shows an exemplary nosecone fittable to an uncapped bottle using threads.

FIG. 28A depicts another type of launchable beverage container product having a reversible finned section and a reversible base in a shipment/storage state.

FIG. 28B depicts the product of FIG. 28A after disassembly from the shipment/storage state.

FIG. 28C illustrates the assembly of the components of the product of FIG. 28A into a standable state.

FIG. 28D illustrates the assembly of the components of the product of FIG. 28A into a launchable state.

FIG. 28E depicts the product of FIG. 28A in a launchable state.

FIG. 29A depicts a launch of a "football" type of pressurizable, launchable beverage container.

FIG. 29B shows a disassembly of the components of the "football" product of FIG. 29A.

FIG. 30A depicts another type of launchable beverage container product having nose sections connected to a body by living hinges.

FIG. 30B illustrates the disassembly of a nose from the body of the product of 30A into a drinkable configuration.

FIG. 32A depicts another type of launchable beverage container product having finned sections connected to a body by living hinges.

FIG. 32B illustrates the disassembly of a finned section from the body of the product of 32A into a drinkable configuration.

Figure 4A:
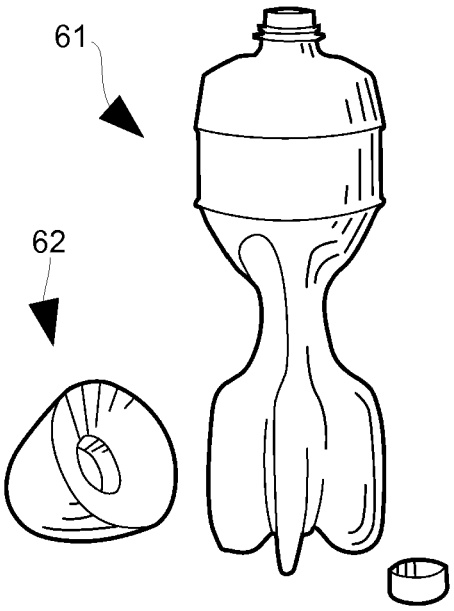
FIG. 4A shows the unassembled parts of a fourth "bomb" type of launchable beverage container product.

Reference will now be made in detail to particular implementations of the various inventions described herein in their various aspects, examples of which are illustrated in the accompanying drawings and in the detailed description below.

DETAILED DESCRIPTION

Nose-Coned Beverage Products

Certain of the products described herein are capable of acting as a container for beverage and for performing a secondary entertainment function. Although several products are described herein that implement such a dual functionality, the nose-coned product depicted in FIGS. 1A, 1B, 1C and 1D provides a convenient introduction. That "missile" product includes a main body container 10 and a nosecone 11. Body container 10 is capable of containing a product, which may be a beverage such as a soft drink or a juice, and may be sealed in the ordinary way through the use of a cap, lid or top. In this exemplary product, nosecone 11 is configured on the inside to fit over the neck of the bottle 10 by way of a snug or tight fit over the cap and bottle neck, although a fitting might also be by mating threads. Other attachment methods may be used equally well in this and other examples; for example a ridge on the inside lower edge of the nose cone could mate to a flute on the outer bottle body, the nose could fit over a lug on the container body, be held in place with a slip fitting, or simply glued. As will be seen from the discussion below, the nosecone 11 may be fashioned of a solid material or alternatively may be formed hollow for example through the use of a compressed gas molding process. Thus it is that body 10 and nosecone 11 serve as a container for which a beverage may be shipped and dispensed.

The secondary function, in this example, makes the bottle body 10 and an attached nosecone 11 into a throwable toy. Although an ordinary beverage bottle has certain unintentional aerodynamic properties, one who has ever thrown such a bottle knows that it is predisposed to rotate and tumble through the air and is not well suited to maintain a low-drag orientation through the air. The exemplary bottle body 10 includes fins 12 molded into the sides of body 10 that serve to stabilize the bottle body in flight with a corresponding aerodynamic improvement, if it is thrown in a proper manner. This product may be thrown like a spear for long distance flights, as a dart for short distances, or held from the tail like a horse shoe is commonly thrown. Fins may provide stability in flight, increase aerodynamic performance, and provide visual appeal. Herein it is also contemplated that appropriate channels, flutes and/or rifling may be used to guide flight or add spin to a bottle in flight, however fins are deemed to be especially aesthetically attractive to provide a rocket-like appearance. Referring to FIG. 1A, In the exemplary bottle fins 12 extend from the bottle body profile 16 such that a portion of the fins 12 passes through the air stream passing across the sides of the bottle body 10. Fins may be located on the bottle body in a location where the body is wide, to take advantage of the increased air speed and compression there.

Body 10 and nosecone 11, when attached, form a throwable toy 13. To throw this exemplary toy one grasps the bottle body near the location 14 (or perhaps a little forward toward the nosecone 11) as one would grasp a spear or a football and launches toy 13 nosecone-first. The launching action may be combined with an action providing spin to compensate for any axial imbalances and provide rotational momentum to maintain the toy 13 in the launching orientation. To improve the aerodynamic characteristics of toy 13, bottle body may be weighted heavy in the nose as compared to the end (in this case the bottle bottom). This may be done by forming the walls and the neck of the bottle in the area marked 15 more thickly. Most advantageously, bottle body 10 may be formed through a blow-molding process, which may be controlled to provide added thickness in the area nearest the neck 15.

The bottle body shown in FIG. 1B may be created using an automated mass production manufacturing process capable of producing hollow parts. These processes include blow molding, rotational molding and others, the choice of which will depend on the rate of protection desired, product cost and quality demands. A mold to produce the bottle body shown in FIG. 1B could include two parts, or could include more pieces to fashion more complicated shapes or features.

A bottle body, such as that of FIG. 1B may be designed to be transported on a conveyor or track and automatically filled with a beverage without tipping, stoppage, jamming or clearance issues by appropriate design and sizing of the fins. The exemplary bottle body 10 includes a cylindrical, non-finned base portion 17 at the bottom to permit the bottle body to be moved through a production and/or bottling process that uses a track; portion 17 is sized to minimize or prevent the interference of a track wall with the fins 12. This base increases the ability of the bottle body 10 to be transported on a conveyor and be automatically filled and capped without tipping, stoppage, jamming, interference or clearance issues. By appropriate design, contouring and sizing of the fins, a beverage product including a bottle body may accommodate existing distribution, sales, vending and dispensing equipment, containers and processes.

Referring to FIGS. 2A, 2B, 2C, 2D and 2E, a throwable beverage bottle may be implemented in many ways. The tear-shaped design shown in FIG. 2A includes a bottle body 20 having fins 22, a base 27 and a neck (better seen in FIG. 2D). The tear-shaped design likewise includes a nose cone 21 shaped to fit over neck portion 15 and provide a smooth contour and transition between the sides of body 20 in the outer portion of nose cone 21. The cross-section of nose cone 21 appears in FIG. 2C, and includes a hollow portion 18 for receiving the bottle neck 15. Referring to FIG. 2D, bottle body 20 includes a protruding shoulder or ridge 19*a* for receiving a channel 19*b* formed in the nose cone 21, providing a securement for the nose cone 21 onto neck 15. Nose cone 21 is made of a pliable material permitting the nose cone to be stretched over ridge 19*a*. Examples of this include many materials used to make foams such as polyurethane, polyvinylchloride (PVC), polystyrene, polyethylene, polypropylene, epoxy, phenolic, ABS, ureaformaldehydes, silicones, ionomers and cellulose acetates. Foams can also be made from resins blended with rubbers to achieve a natural resilience. Closed-cell PVC foams with nitrile rubber (Ensolite) are a good choice. PVC can also be plasticized to obtain soft and resilient foams. Both rigid (stiff walls) and flexible (walls collapse with pressure) foams can be used to fashion a nose cone. Other materials that might be used include expanded polysterene foam, polybutadiene rubber, open cell ester, neoprene and ethafoam. Nosecones of other configurations described and/or claimed herein may be formed of these materials, recognizing that some nosecones may be better harder or softer and more or less flexible. Alternatively, a nose cone might be made of a stiff or hard material, for example ordinary thermoplastic, and the bottle body could be made pliable.

Although a nose cone may include threads fitting to the threads of a bottle neck, this nose cone 21 does not. Rather, the interior 23 is shaped to simply slide on neck 15 without interference from any threads or other features formed in the neck. Alternatively, the interior 18 could be made slightly smaller than the threads or other neck features to provide a friction-fit of the nose cone on the bottle. In yet another alternative, the interior of a nose cone may be fashioned to fit over a capped bottle, using either a slip or a friction-fit. Examples of these variations will become clear in the discussion below.

Again, in the tear-drop design the nose-cone fits over the bottle neck 15. In its shipped configuration a cap, not shown, is intended to be located to neck 15 to contain the bottle contents. Nose cone 21 is designed to snap fit over the shoulder of bottle body 19*a* and may be removed and reattached repeatedly by the end-user. A cavity formed in the nosecone 21 is sufficient to contain the mouth of a capped bottle body 20 when the nosecone is fitted thereby. This product, including bottle body 20, the cap and nosecone 21 may be packaged, shipped, distributed and sold in the fully assembled state shown in FIG. 2A. Alternatively, nosecone 21 could be shipped in an unmounted configuration, for example, by inclusion within a box containing bottles as shipped. Alternatively, the nosecones could be provided as an unattached or separate item, for example in a bin separate from a shelf on which their corresponding beverages are located. Further yet, a nosecone such as 21 could be shipped with bottle body 21 positioned in a near-final position (assuming that the capped bottle prevented a final fit) and attached either loosely or with a fastener such as shrink wrap, elastics or even adhesive tape.

FIGS. 3A, 3B and 3C depict a "spinner" design having several noteworthy features. The reader will now recognize the bottle body 40 and nosecone 41 features of this design. As seen in the cross-sectional view of FIG. 3F, a nosecone 41 may be configured to receive by friction fit or a slip-fit a cap 49, through inner surface 50*b*, by which bottle 40 may be a closed container. In another example shown in FIG. 3E, a cap may be configured to receive a cap 49 by detents 50*a*. This design, however, does not include a base as identified as 17 or 27 in the missile or tear-drop bottles. Rather, fins 42 are configured as a stand for bottle body 40, and are provided for on opposing sides to provide balance. Furthermore, several fins 42 are provided in a circumference similar to bases 17 or 27 so as to provide a portion that will fit within a track of a bottling machine.

Furthermore in the "spinner" design, fins 42 are angled or twisted with respect to the axis of symmetry. This serves to generate rotation around the axis of the bottle when thrown, providing rotational momentum and stability in flight. The severity of the angle may be gentle to conserve energy for long flight, or more severe to provide amusing motions. Angled or twisted fins may be provided in virtually any throwable bottle design as desired.

Now referring to FIG. 1E, an exemplary throwable container 30*s* having straight fins is depicted, having an axis of symmetry 31 passing through neck 32. It is to be understood that the container need not be entirely symmetric, and that axis 31 for the purposes of this discussion need only pass through neck 32. Displayed with container 30 are two straight fins as seen in a forward view 33*f* and a side view 33*s*, those fins separated by 90 degrees on the circumference of the container. Fins 33f and 33*s* are straight, like fins 12 on container 14 as shown in FIG. 1D. These fins are straight in the following sense. Each fin is substantially symmetrical on both sides of a plane passing through the substantial center of each fin, and for a straight fin such a plane intersects with the axis of symmetry of the container 31. For fin 33*s*, the plane would be parallel to the page, and for fin 33*f* the plane would be perpendicular to the page. In the example, for both fins the intersection of their respective central planes is a line on axis of symmetry 31. The container 10 depicted in FIGS. 1B and 1D is such a container having straight fins.

On the other hand, a throwable container 30*a* having angled fins, one example shown in FIG. 3D, will have a different geometrical arrangement. This container 30*a* also has an axis of symmetry 31, but forward fin 34*f* and side fin 34*s* are angled, like fins 42 in body 40 of FIG. 3B. These fins also have a plane passing through the center of each fin, which for fin 34*f* would appear to the viewer as line 35 and for fin 34*s* as a plane rising out of the paper toward the top of the page. However, here the intersection of axis 31 with these planes is a point, 36 as shown. The container 40 depicted in FIGS. 3A, 3B and 3C is a container having angled fins.

In the missile and spinner designs the container space of the bottle resides with substantially equal weight from the bottom of the bottle to the narrowing portion of the bottle neck. This configuration is desirable in those instances where it is more important to maximize container volume. Alternative configurations may also be used. For example, the bottle shape of the tear-drop bottle positions more container volume toward the neck portion. Other configurations are described below which position more container space toward the bottle foot. This can enhance the aerodynamic properties of the bottle/nosecone product, particularly where the product is designed to be tossed or thrown with fluid or other material inside.

Figure 4C:
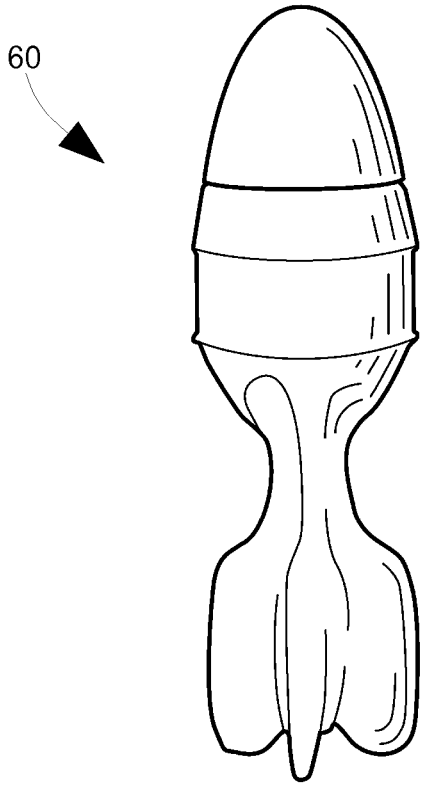
FIG. 4C depicts the "bomb" product after assembly.
Figure 4B:
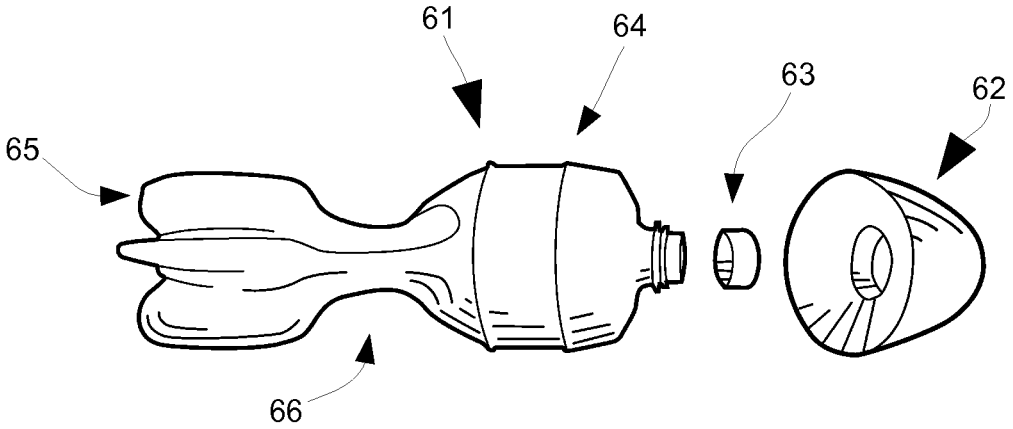
FIG. 4B illustrates the assembly of the nosecone, cap and body of the "bomb" product.

The "bomb" bottle-product 60 shown in FIG. 4C is a good example of this. Looking to FIG. 4B, that example includes the now-familiar bottle body 61, rounded nosecone 62 and cap 63. There, the majority of the container volume is located near the top of the bottle 64, and the volume in the center 66 and somewhat as to the fins 65 is reduced. In this design, (1) the nose cone section is comparatively larger and therefore heavier, augmenting its ability to fly farther, (2) the fins on the container are extended farther from the nose cone section adding stability in flight and a better balance and weight distribution, (3) the back end of the body is extended as is "boat tailed", improving aerodynamic stability and ergonomics. To use this bottle, one consumes the beverage inside and then fills the container with ordinary water, recognizing that performance will be enhanced by the removal of any entrapped air. The cap 63 is applied and tightened, and nosecone 62 is inserted onto the cap 63. Here, nosecone 62 substantially grips only the cap 63, and is therefore made with an appropriate friction-fit to avoid the cap becoming dislodged during launch.

Having fitted the nose cone 62 onto cap 63, the user may then throw the product by gripping the widened portion 64 with his thumb and forefinger located near narrowed portion 66 using a similar motion as to throw a football. This design, however, permits an alternate launching motion; the user may grip the end of the bottle between the fins 65 and, moving his arm in an arc, may provide a centripetal launching force to the product 60 and release the product in the appropriate point of the arc to launch the product in either an upward direction or in a direction substantially above the horizon.

Again, the product 60 is intended to be launchable in a filled condition. Because of this, product 60 has significantly more weight than other products disclosed herein intended to be launched in an unfilled condition. Although added weight permits a product to overcome air drag and fly farther, the product will also strike the ground with greater momentum at the end of its flight. For those products intended to be launched in a filled condition, a nose cone should be selected of an impact-resistant material. The nosecone may also be selected from the set of softer materials to prevent injury or damage to a person or objects impacted by the product. Here, nosecone 61 is formed of a two-part self-skinning foam rubber, similar to that used in the Nerf-type sports balls.

As to other materials that may be used to fashion a nosecone, many may be selected depending on the hardness, resiliency and weight desired. These materials include, but are not limited to, foams, thermoplastics, thermosets and elastomeric materials. Processes to make nosecones, detachable fins and tail sections, and other extra-bottle parts include injection molding, compression molding, casting, foaming and many other processes. The reader will note from the description above that heavier materials in a nosecone and lighter materials in a tail section will generally increase the aerodynamic stability of the assembled, throwable products.

The design and dimensions of the fins may permit modular stacking and grouping of the bottles, which may prove to be advantageous for shipping and packaging. Thus, containers may be configured so that the fin of one container fits into the recess between the fin of another container. For example, the fins 12 of FIG. 1A recess into the area 18 near the center of the base and between two fins. That is better seen in Figures 1A and 1F, showing the stackability of this bottle shape. F*igure* 1A shows two stacked bottles as seen from the side containing neck 15, with fins 12 shown in dashed lines where obstructed. Likewise, FIG. 1F shows the stacking of two bottles sectioned at the location "A" in FIG. 1D, the dashed lines showing the outline of base 17 where obstructed by fins 12. As can be seen in the example, the recessed area 18 may be shaped to receive the outer shape of a fin 12 such that two stacked bottles are provided with a greater contact surface area. Other containers described herein have a like configuration, capable of stacking in substantially the same space as would a set of non-finned bottle bodies.

All of the missile, tear-drop, spinner and bomb examples are provided with fins that are molded in. Providing fins in a bottle body has the advantage that no additional step of manufacture is required; rather the bottle body comes out of a mold substantially finished.

Other features may be included to improve the aerodynamics of a launchable beverage-model product. For example, the body of the bottle may be elongated for added stability, shortened to fit a container or shaped or sized in many ways while maintaining its containing, throwing and flying functions. The throwing balance of the bottle body may be improved by reducing the size of the lower trunk, which may also improve the hand-ergonomics and the aerodynamic properties of the bottle. Additionally, other ergonomic features may be provided such as finger divots or palm contours. The weight and balance of a bottle body may be modified as desired to enhance throwing and flight characteristics.

The appeal of this type of beverage container is that after use these may have entertainment value as a toy, certain of which may fly stably and aerodyamically. Certain of these may have a rocket shape or other shapes as disclosed herein, providing entertaining, amusing or competition activity after the consumption of a beverage.

Production Sleeves

The fins 65 of bottle body 61 may provide difficulty in integrating the shape into existing bottling processes. Now referring to FIG. 5E, production sleeves 67*a* and 67*b* may be used to provide a shape compatible with bottling tracks and processes. These sleeves generally slide over the tail section of bottle body 61 providing a profile relative to neck 68 that places the opening in a location compatible to a bottling machine. The height of a sleeve need not extend the full length of a bottle body, but may if that proves to be advantageous or desirable. Sleeves may include internal ribs 69 to receive and restrain fins 65 and thereby prevent the bottle body 61 from rotating with respect to the sleeve 67*a*. Ribs are not required; rather any restraining internal features may be used such as channels, pins or separators. It is not necessary for these features to extend all the way along the sides, however use of a two-part mold may result in that configuration. This may be helpful where cap 63 is placed on bottle 61 through a twisting process, where the absence of rotational restraint would prevent the tightening of the cap. On the other hand, a sleeve without ribs 67*b* may be used where a cap is applied through a different process, such as a press or snap-on motion, or with a sealed membrane. This sleeve may be used and recycled or discarded after manufacture, or it may remain for the consumer to remove. A sleeve may be formed from any suitably stiff and strong material, including aluminum, plastic or even cardboard.

Figure 5A:
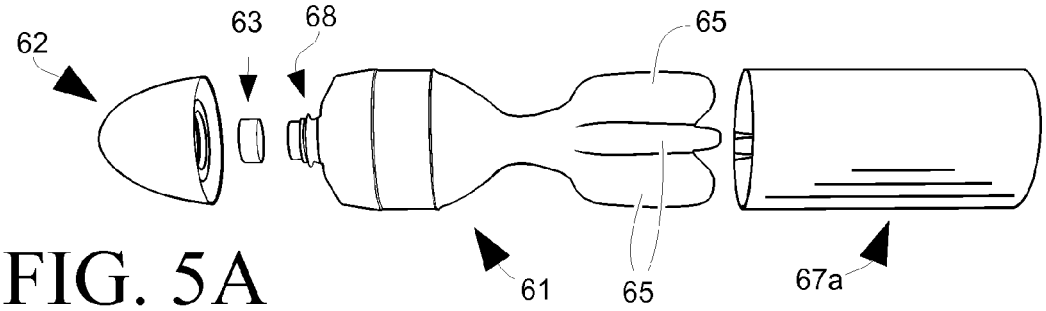
FIG. 5A shows the unassembled parts of the "bomb" product including a production sleeve.
Figure 5B:
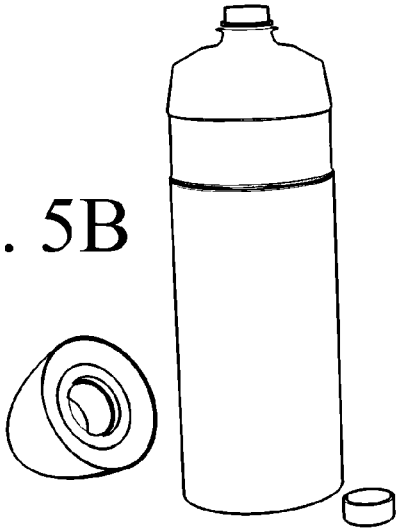
FIG. 5B depicts the "bomb" product with production sleeve in a ready-to-consume state.
Figure 5C:
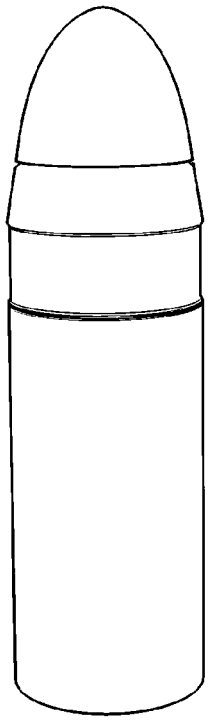
FIG. 5C depicts the "bomb" product with production sleeve in a fully assembled state.
Figure 5D:
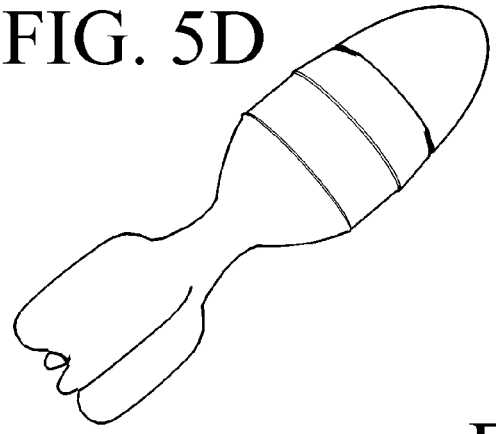
FIG. 5D depicts the "bomb" product with the production sleeve removed, and in a launchable state.
Figure 5E:
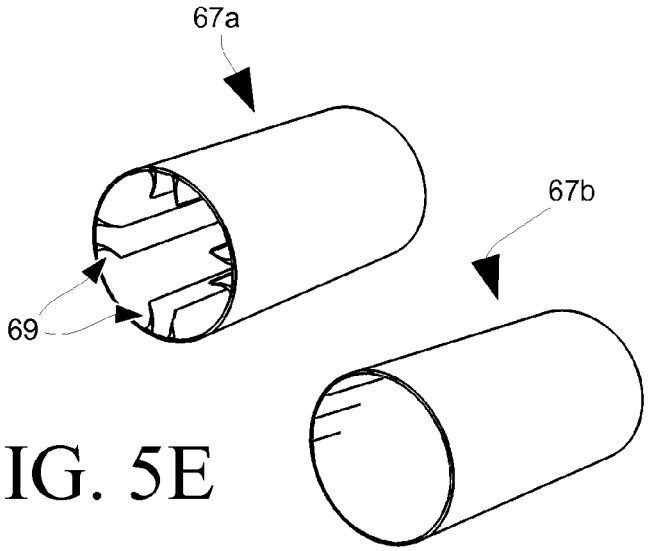
FIG. 5E depicts two production sleeves, with and without anti-rotation ribs, adapted for the "bomb" product.

The assembly positions and orientations of bottle body 61, cap 63, nosecone 62 and sleeve 67*a* or 67*b* are shown in FIG. 5A, with FIG. 5C showing the final assembly of these components. The state of these components after beverage consumption is shown in FIG. 5B. The sleeve is then removed and the cap and nose are applied before flight, in the configuration shown in FIG. 5D.

Lugged Nosecone

Figure 6B:
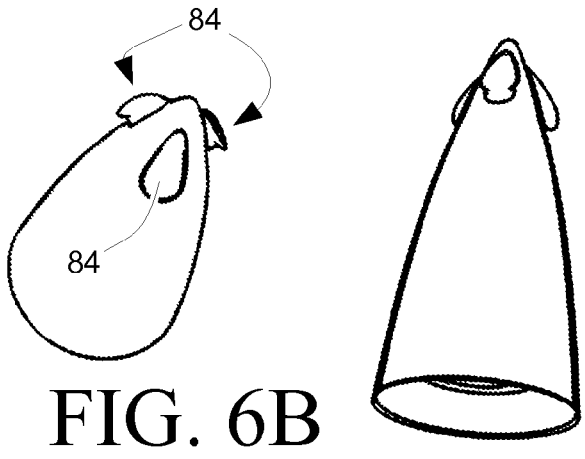
FIG. 6B shows nosecone from two angles of fifth type of launchable beverage container product with launching lugs.
Figure 6A:
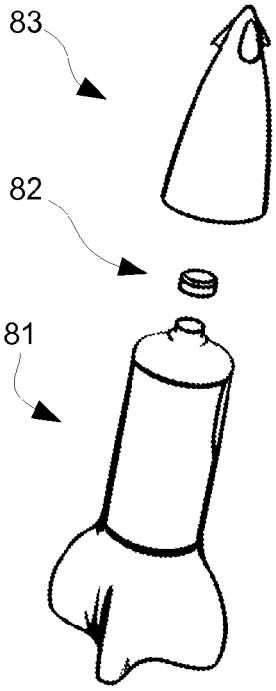
FIG. 6A illustrates the assembly of a nosecone, cap and body of a fifth type of launchable beverage container product having launching lugs.
Figure 6C:
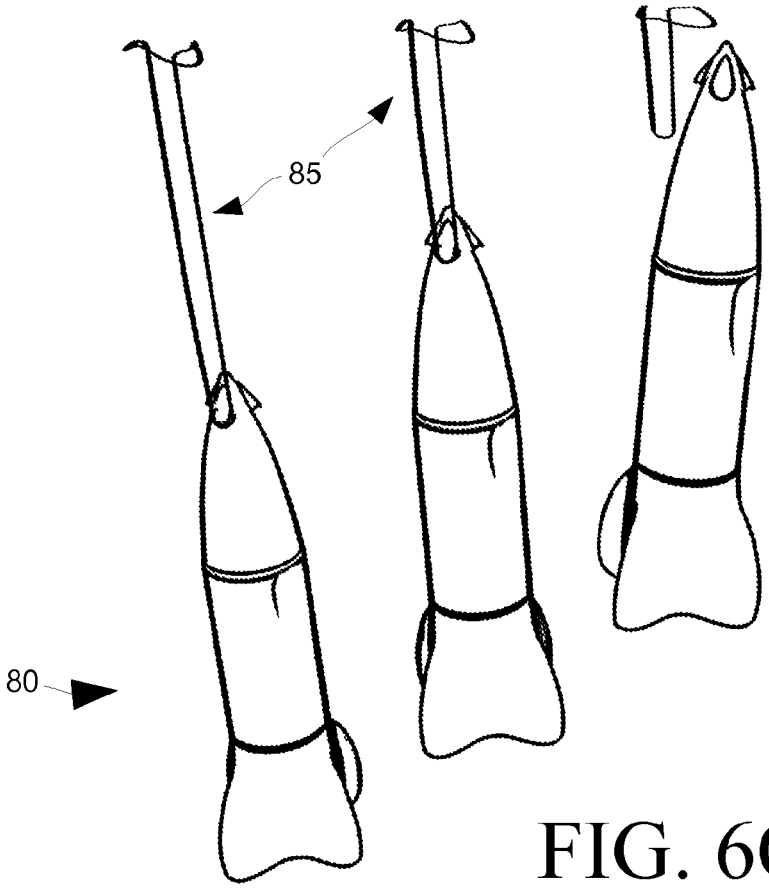
FIG. 6C illustrates a launching procedure for the fifth type of launchable beverage container product with launching lugs.

A launchable beverage product may provide for means of launching other than by hand. Referring now to FIG. 6A, a launchable product includes a bottle body 81, a cap 82 and a lugged nosecone 83. After consumption of a beverage, all three parts are fitted together in the positions and orientations shown. FIG. 6B shows views from two directions of nosecone 83. This nosecone includes cleats or lugs hooked to receive a elastic member, which could be for example an elastic cord ended with a ring or an ordinary rubber band. Note that although three lugs are shown, only one is needed for this product implementation. Referring now to FIG. 6C, this product can be launched by hooking rubber band 85 onto one or more of lugs 84, holding the rubber band opposite the hooked portion in place, pulling back on the product 80 and releasing when the tension in the rubber band 85 is as desired for launch. Note that in this example the coupling between nosecone 83 and cap 82 must be of sufficient strength to withstand the pulling forces introduced in the launching of the product. Such a coupling or connection may be made with threads, teeth, pins, adhesives or by other means.

For consumer presentation and storage, an elastic cord or rubber band could be contained within the nosecone 83, or could be located around the product or within any outer packaging provided. Such a nosecone could be made of a hard rubber, silicone, plastic or like materials to endure the forces of stress introduced on the nosecone, particularly in the area of a lug. Alternatively, a cleat could be formed of another material, such as metal, and embedded within a nosecone at the time it is molded. This way a softer and perhaps lighter nosecone material could be used such as foam rubber. This nosecone could be made either hollow or solid, and processes such as blow molding, rotational molding and others could be used.

Nosecone with Cavity

Figure 7A:
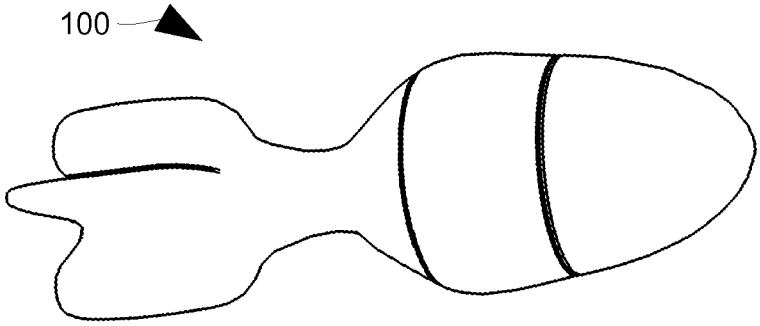
FIG. 7A depicts an assembled "bomb" type of launchable beverage container product having a prize cavity in the nose.
Figure 7B:
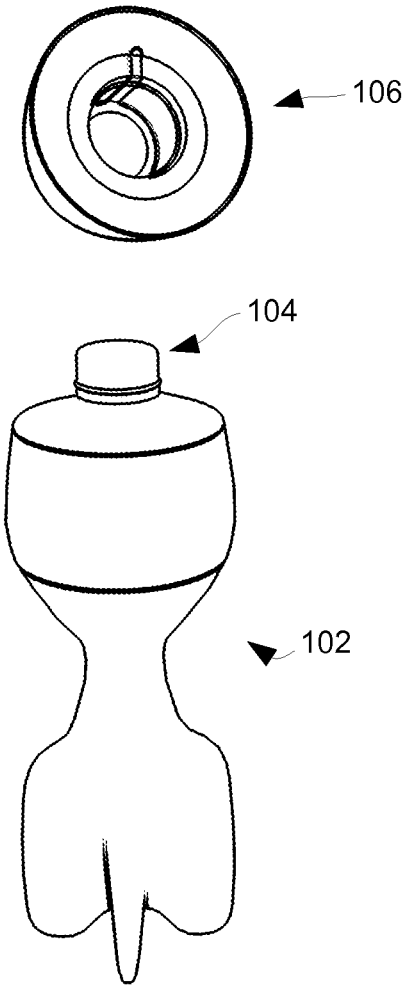
FIG. 7B shows a holding clip securing an object inside a nosecone cavity in the "bomb" type of product.
Figure 7C:
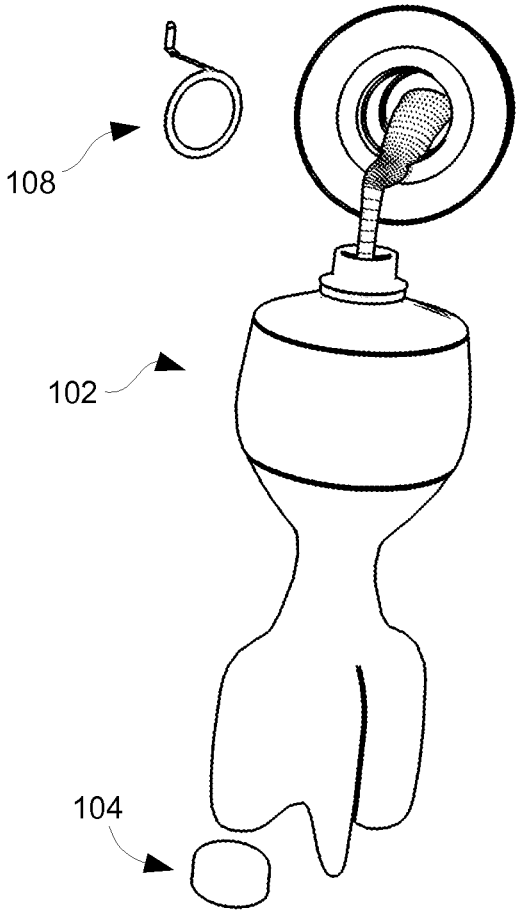
FIG. 7C illustrates the application of a beverage additive stored in a nose cavity in the "bomb" type of product.

Referring now to FIG. 7A, a throwable beverage product may incorporate a cavity for holding prizes, flavorings, colorants or other objects. Looking at FIG. 7B, the product as supplied to the consumer includes a body 102 sealed with a cap 104 and a nosecone 106, which may be supplied affixed to the cap and/or body. The cap may be removed as shown, and hidden inside may be a clip 108 that secures a liquid, powder, ingredients, toy or other object. This object might be a drink additive, vitamins and minerals, a fizzy activator, flavoring, coloring, etc., poured into and mixed with the beverage, as shown. It might also be a toy, prize, rubber band or a separate food article such as gum or candy. The cavity may be sealed by a removable paper, plastic, membrane or foil cover to seal in the contents, providing protection in transit. The contents of the cap may be sealed in by a clip or other securement such as 108, or may simply be held in place by placing the nose cone over the bottle in its place, including the top and/or bottom of the bottle. Adding a cavity to a compressible or elastic nosecone may provide for more room for the nosecone to deform on impact, softening such impact and providing for a safer product.

Attachable Finned Sections

Figure 8A:
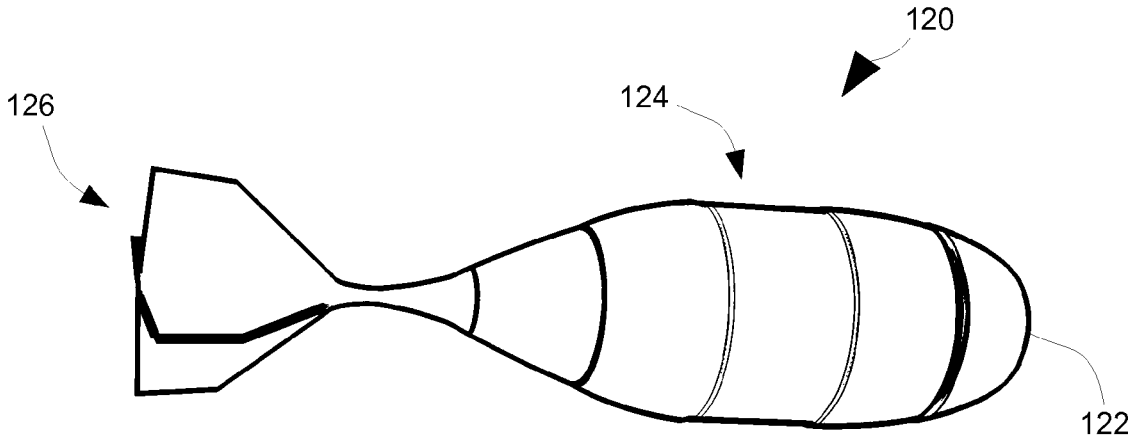
FIG. 8A depicts an assembled a "bomb" type of launchable beverage container having a bottle base attaching nose and a neck attaching fin section.
Figure 8B:
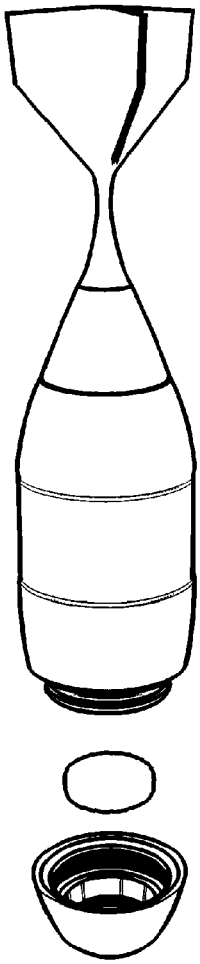
FIG. 8B illustrates the storage of a cap with a cavity formed between a nose and body in a "bomb" type of product.
Figure 8C:
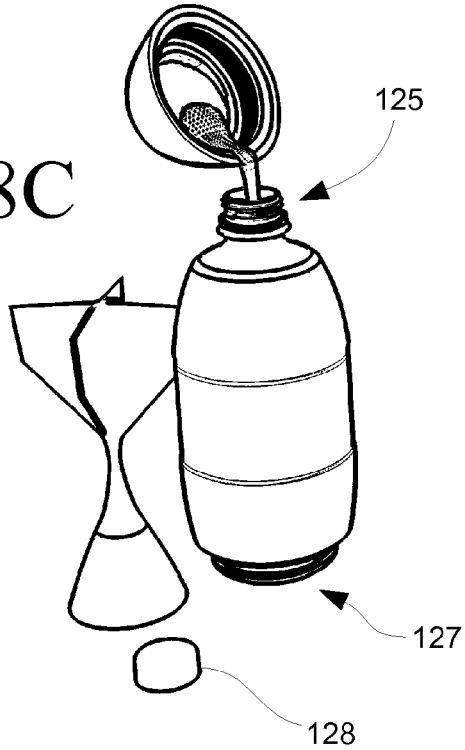
FIG. 8C illustrates the application of a beverage additive stored in a nose cavity in the "bomb" type of product of FIG. 8A.

FIG. 8A depicts the final assembly of a tossable beverage container of the bomb-type shape. Looking to FIG. 8C, in this example the nose 122 again contains an additive that can be applied to the contents of bottle body 124. However, in this example nose 122 does not attach to the neck portion 125 of the container 124, but rather attaches to its base 127. This nose 122 attaches to base 127 by way of a circumferential ridge, much like the example of FIG. 2D. The particular shape of a nose or nosecone is largely an aesthetic choice, although one may be more aerodynamic than another (a rounded nose might usually be more aerodynamic at speeds these products may encounter); hereinafter the term nose is used for a flattened or non-pointed nose and nosecone for a pointed nose, however it is to be understood that the terms nose and nosecone refer to the same functional element with respect to the products presented and claimed herein.

To this point the discussion has centered around the bottle bodies that have molded-in fins. It is not necessary to provide molded-in fins, but rather fins may be provided that attach to a bottle body in numerous ways, including in this example a finned section that mounts fins by way of a common structural element. This example is intended to be sold to the consumer with the finned attachment 126 not attached and perhaps provided separately, but with nose 122 attached. In this configuration nose 122 is rounded, and as that configuration will easily tip and fall an additional container, for example a sectioned cardboard container, may be used in shipping and also provided to the consumer. Base 127 is substantially flat to allow bottle body 124 to stand upright after removal of nose 122, which may be performed by the consumer perhaps in connection with the application of any additives contained in the nose 122. In an alternative configuration, nose 122 is not rounded but rather has a flat surface to allow the attached nose to act as a stand for the combination of a bottle body and nose. In yet another configuration the nose 122 is provided to the consumer separately permitting bottle body 124 to stand on a shelf near the point of sale. Nose 122 fits to body 124 in this example by way of a lug that extends around the circumference of the bottle.

For this example, the nose is applied to the bottle base 127 and the finned section 126 attaches to the bottle neck 125. Also in this example, finned section 126 has interior threads that mate with the cap threads configured to receive a cap 128 on neck 125. In alternative designs a finned section 126 might function as a cap, or might be fixable to a cap. A finned section that screws onto bottle neck 125 has the advantage that that section can act as a cap for bottle body 124 and seal and/or contain the contents thereof. Alternatively, a finned section could attach in other ways such as by tabs, snapped ridges, adhesives, etc., however the presence of threads on neck 125 provides a convenient attachment point.

Also in this example, cap 128 may be inserted into the cavity in nose 122 before the nose is applied to base 127. In this way all of the product components may be present in the throwable configuration and no component is left loose and needing to be held or disposed of by the end-user, providing convenience to the user.

FIG. 9A shows in a shippable state 140 a "spy bottle" design having several distinctive features. This example includes a bottle body 141 on which is positioned a tree 142. FIG. 9C shows the components of this design in a disassembled state, which would occur for example after consumption of a beverage contained in the bottle 141. To use the bottle, a user first removes the tree 142 and cap 143. At some time before launch of the product the tree is separated into its component halves, which are a finned section 142*a* and a nosecone 142*b*, which provides an interactive element for the user. In this example, nosecone 142*b* provides a receptacle, not shown, for receiving cap 143 by a friction-fit and thus placement onto the neck of bottle body 141. It is to be noted that tree 142 need not be attached in any fashion to bottle body 141, rather it may simply be loosely placed or attached with mild adhesives or shrink wrap at the point of sale.

To launch this product, the consumer places nosecone 142*b* over the neck of bottle by way of cap 143. In this example, finned section 142*a* includes a threaded section at the point of attachment to bottle body 141, although other attachment features might be used including a friction fit, tabs, hooks, etc. Bottle body 141 includes a receptacle on its base, not shown, configured to receive the attachment feature of finned section 142*a*, which in this example is a threaded cavity in the center of the bottle base. The attachment of finned section 142*a* to bottle body 141 may be by a permanent method (i.e. the finned section is not removable) or it may be by a temporary method permitting a more compact form for transportation and/or storage.

Pressurized Throwable and Launchable Beverage Products

Certain of the throwable or lauchable beverage products described herein may be pressurized to achieve certain advantages. Those products may incorporate a pump, operable by an end-user by which air pressure may be provided to a beverage bottle. The product depicted in FIGS. 10A, 10B, 10C 10D is exemplary of those products.

Figure 10C:
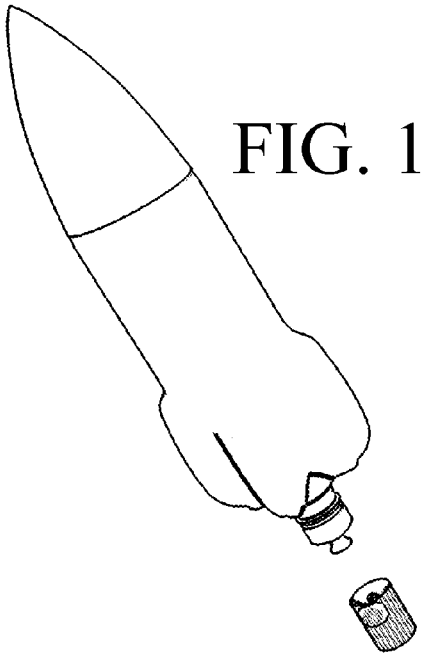
FIG. 10C depicts the first pressurizable product in a launchable state.
Figure 10D:
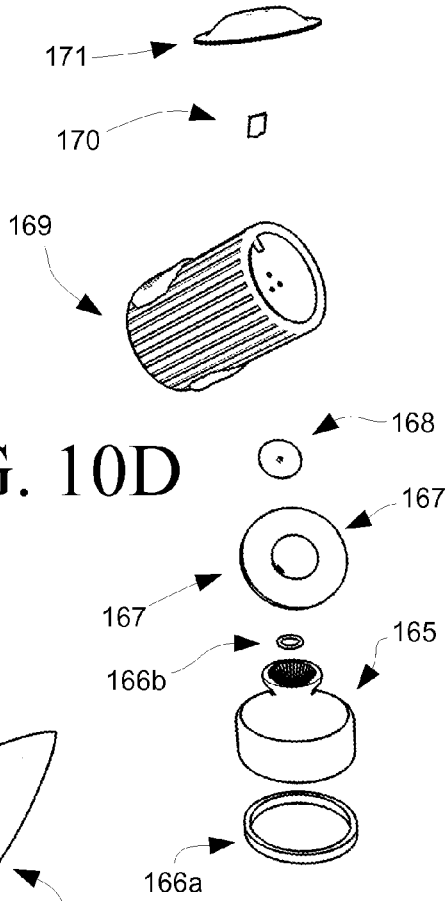
FIG. 10D illustrates the components assembly of the nozzle and pump of the first pressurizable product.
Figure 10A:
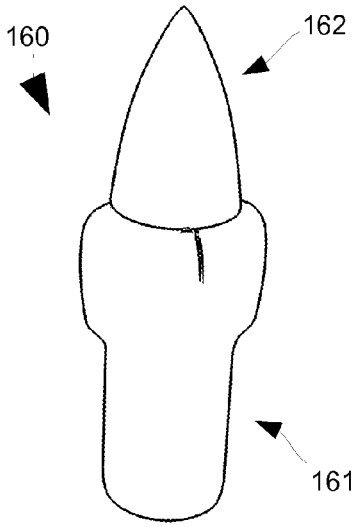
FIG. 10A depicts a first type of pressurizable, launchable beverage container product in a shippable state.

Referring to FIG. 10C, an exemplary pressurizable product is presented in its shippable state. Here, the internal components may not be visible, but rather the nosecone 162 may cover the opening of bottle body 161 and any associated parts. Note that in the shipped configuration the fins molded in bottle body 161 are located near the nosecone and the opening in the bottle body.

Figure 10B:
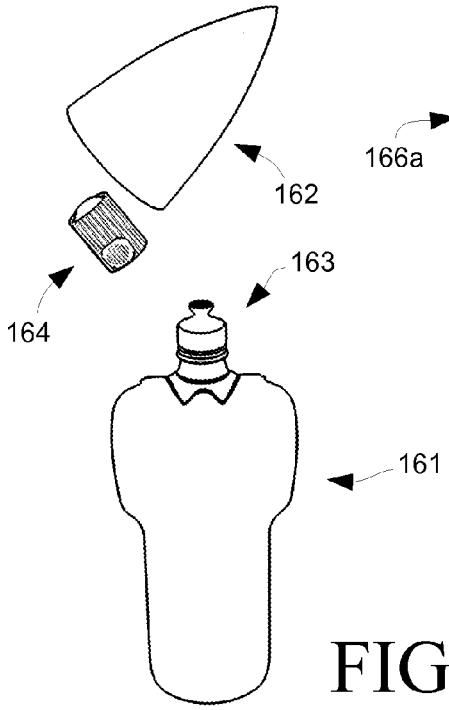
FIG. 10B illustrates the disassembly of first pressurizable product by the consumer.

To consume the contained beverage, the nosecone 162 is removed from the bottle opening, exposing a nozzle 163, as shown in FIG. 10B. A pump 164 may be conveniently stored under nosecone 162, or may be stored elsewhere as desired. The beverage contained in bottle 161 may be consumed through nozzle 162, and the walls of bottle 161 may be flexible so that a consumer may squeeze the bottle and accelerate the dispensing of the beverage contained therein. Alternatively nozzle 162 may be removed and the beverage consumed directly through the opening in the bottle 161.

To launch this product the nosecone 162 is placed on the end opposite the opening of bottle 161, providing a more aerodynamic profile than if the flat bottle bottom were presented as a nose. Bottle 161 is configured to receive nosecone 162 at either end, for example by friction-fit or by a snap feature built into the nosecone and bottle. Nosecone may be fashioned of a hard material such as plastic, or could be made of a softer or elastic material providing for softer impacts and improved grippability onto bottle body 161. The intended procedure includes the filling of bottle 161 partially with water, although that is not strictly required. A mark could be provided on the bottle 161 as a fill line suggesting the optimal level of water, or alternatively it could be left to the consumer/user to experiment. The consumer would then secure the nozzle if necessary.

Next the pump 164 is positioned over nozzle 163 by inserting the spigot with o-ring onto the nozzle opening until the cuff and launching lugs of the pressurizing cap snaps over the nozzle rim and seats around the base of the nozzle. The user then pressurizes the container by repeatedly depressing the diaphragm 171 on the top of the pressurizing cap 169. Once a sufficient pressure is reached, the user would turn the bottle with nosecone 162 pointing up, and with one hand and holding only the pressurizing cap 169 pinches the base cuff. By pinching the cuff at the points 90 degrees from the location of the retention lugs, the cuff will bend from circular to oval. The lugs are on the inside of the cuff at the part of the oval farthest away from each other. As the user pinches the cuff, the lugs on the cuff separate with enough space to slip past the rim of the nozzle, allowing the pressure in the bottle 161 to push off the spigot and launching the product. FIGS. 14A, 14B, 14C and 14D show the pump of FIG. 10D in several different orientations and assembled conditions.

Continuing to FIGS. 11A, 12A and 13A, pumps are shown in three configurations. Looking first at FIG. 13B, the components of the pressurizing cap of FIG. 13A are shown in exploded view, having a cap body 169, a flexible diaphragm 171 and upper and lower check valves 168 and 170. The upper check valve lets air back into the diaphragm on completion of a pump stroke (by applying pressure to the diaphragm) and the lower check valve opens to let air into the container and closes as the pressure equalizes and becomes greater in the bottle. When the diaphragm is pressed the upper valve closes and the lower valve opens, reinflating the diaphragm, and setting the system up for another pump of air into the container. The one-way check valves may be fashioned of flexible material such as rubber or silicone, covering a set of holes in the body 169 and secured in the middle. Other types of check valves may be used, such as a duck-bill type. FIG. 12B shows the components of an alternate pressurizing cap, with the differences being mainly in the type of check valves used.

A pressuring cone may also be used, as shown in FIG. 11A. This configuration combines a nose cone with a container cap and adds the feature of a pressurizing pump. This pump is configured with an air chamber and two one-way check valves. The air chamber is formed by a flexible cone at the tip of the nose cone. Pressurizing is by depressing or compressing this tip thereby forcing air through the cap check valve. As the tip returns to its normal non-depressed state, the check valve on the cap closes (maintaining the pressure created in the container) and the check valve on the air chamber opens allowing air back into the nose cone. This procedure is repeated to build up bottle pressure.

Any of these pressurizing caps may be used to build up pressure in a bottle for thrust, but also provides a way for a drink container to be re-pressurized in order to preserve freshness, particularly for carbonated beverages. A pressurizing cap may also provide stabilizing pressure for maintaining a container's shape as a toy meant to be thrown. In this way, bottles of a thin or flexible wall may be used, potentially saving cost and permitting the bottle in some cases to be collapsed for storage.

Referring now to FIGS. 15A-E, a pump for compressing air into a bottle may be of a piston-type. A piston pump carries the advantage of shorter time to pump a similar volume as a diaphragm-type pump, although a piston pump is not as compact and may require additional volume in shipping a beverage product. This piston pump includes a ram 180 that is moved in a cylinder 181, moving a volume of air through the various check valves. A releasing cap ring 169*d* provides for uncoupling of the pump to a bottle and nozzle by a squeezing pressure, as in the examples above.

Alternative Shapes

Figure 16:
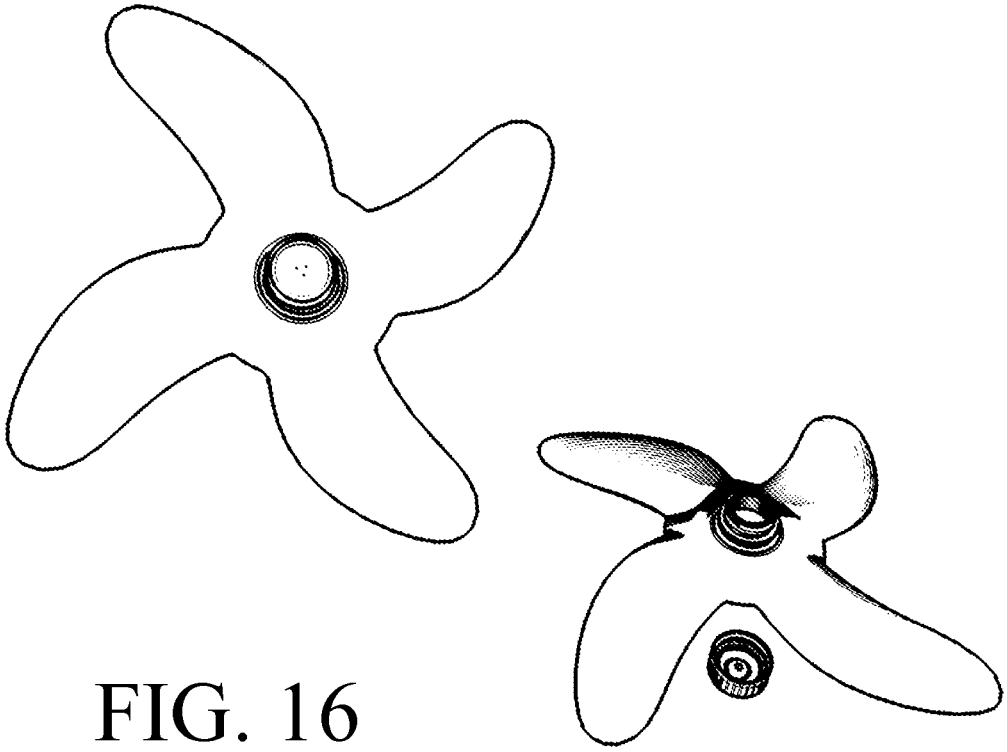
FIG. 16 depicts a "boomerang" type of launchable beverage container product in a capped and uncapped state.

Rocket, missile, bomb shapes and the like are merely examples of shapes that can be used in a launchable beverage container. Other shapes may be used, for example in the boomerang bottle shown in FIG. 16. In that example, the purchaser consumes the beverage through the opening in the center. Once empty, the product is sufficiently light that it can be used as throwable entertainment without substantial risk of injury. This product is shaped such that it can be thrown from one of its arms like a boomerang, and might be shaped for particular flight, such as long-distance or returning in the direction of the thrower.

Figure 17:
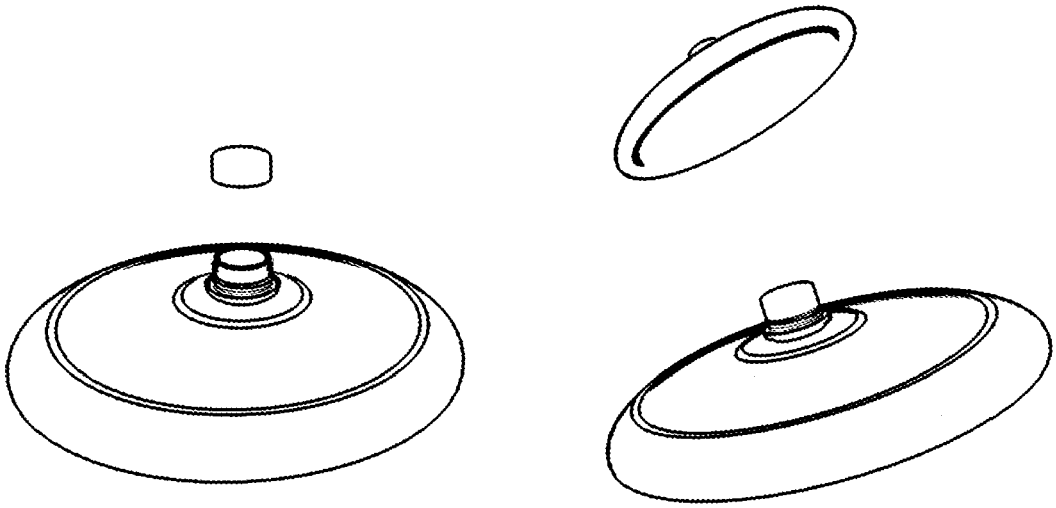
FIG. 17 depicts a "disc" type of launchable beverage container product in a capped and uncapped state.

Referring now to FIG. 17, a bottle might be shaped in a disc, which could be thrown with rotational momentum in the way that other flying discs are. The manufacture of either of the examples of FIGS. 16 and 17 may be more complex, however these are still susceptible to manufacture through a blow molding or a rotational molding process, as well as others. Additionally, these and other examples could include a pump as described above rather than a cap, providing internal stiffness particularly where a bottle is made from thinner or flexible walls.

Atlatl Beverage Container

Similar to the products described earlier is the product depicted in FIG. 18A, having a container body 200, a nosecone 202 and a throwing arm 204. Looking to FIG. 18B the components of this bottle are simplified in that the nosecone acts as a cap for the contents of the container body 200. Here, body 200 is elongated into a shape similar to a spear, with that kind of aerodynamic properties. Throwing arm 204 could be provided with body 200 at the point of sale, or could be provided separately as an add-on product. FIG. 18C shows the several stages of launch using the throwing arm 204. Generally, the user places the container bottom end on the hooked tip of the throwing arm 204 with bottle 200 resting in the arm's cradle. The user holds the throwing device in her throwing hand at the handle end in such a way that the front of the container is facing front, the rear of the container is facing backwards and the container is on top of the throwing arm, with both above the hand. Holding the arm, the user flicks the throwing device in substantially a throwing motion, which in turn applies launching force against the bottom of the bottle. Bottle 200 could be made in the ways suggested above, and arm 204 could be made with the same processes (it may be hollow) or it could be made by another process and material that provides sufficient stiffness for the launching function.

Reversible Fins

Referring now to FIG. 19A, another tossable beverage container product is shown having reversible fins. That product again includes a beverage container body 210 that mates with a finned section 211, with fins extending outward as shown. The fins are reversible to point inward, as shown in FIG. 19B, by providing body 210 with an appropriately accepting profile and through a double-mating built into finned section 211, in this example by threads that mate with threads on the neck of the bottle body. In this example finned section 211 also acts as a cap, sealing in the contents of body 210 when in the position shown in FIG. 19B. This position also presents a compact form suitable for transport and packaging. The other, throwing position provides better aerodynamic guidance and stability by way of fins distant from the body. Other matings may be used, for example a hole in section 210 that mates with a detent in body 210. This example includes a pliable nose 212 that snaps onto body 210 and provides impact protection as in previous examples. Finned section 211 may be sufficiently strong to permit the product to be thrown or swung by the fins, although in other versions the fins may be weaker and the user might be left to throw the product from the bottle body 210.

In an alternate configuration, finned section 211 does not seal body 210 but rather contains a passage for the flow of air in and out of the bottle body when in its throwing position. This may also allow pressure to escape from a bottle body designed to collapse, examples of which are described below. A non-sealing cap may also communicate to the user that the bottle is designed to be thrown empty. Note that this feature is not limited to reversible caps, but rather may be implemented in any cap or finned section in conformance with a beverage bottle's sealing requirements.

Figure 21:
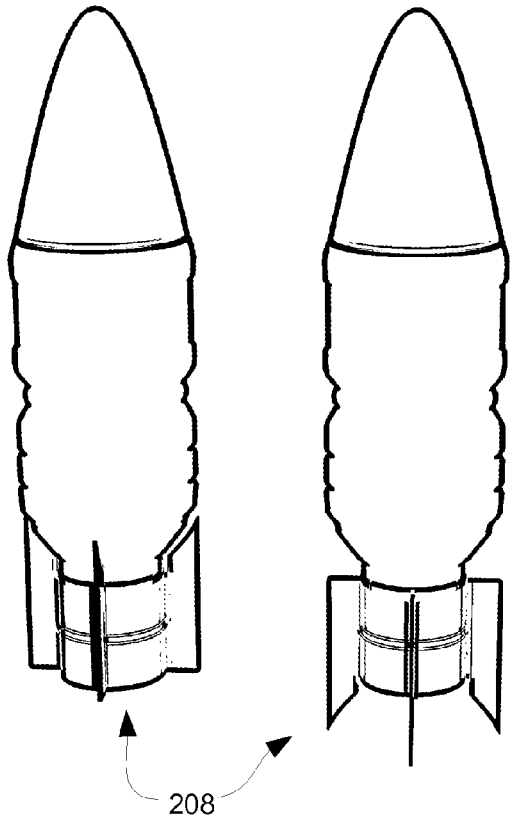
FIG. 21 depicts another type of launchable beverage container product having a reversible finned section and a common water bottle.

Now referring to FIG. 21, a cup 208 rather than a cap may be used, being applied to the bottom of the bottle (the end oppose to the neck.) This cup 208 is substantially flat on the bottom permitting it to act as a stand for its bottle.

Crush Zones

Referring now to FIG. 20B, another tossable beverage container product 330 illustrates the feature of a crush zone 332 (two bottles are shown, one in a compressed state.) In this example crush zone 332 is implemented in corrugated or accordion style, permitting the sides of bottle body 331 to collapse and/or shorten, thus absorbing impact energy applied to the base of body 331. A crush zone may be designed to operate with or without cap 333; if the cap is present a portion of the impact energy will be absorbed by the compression of air within body 331 while providing more bounce. The number, angle and depth of folds in crush zone 332 is selected to match the material and thickness of the sidewall of body 331 to permit flexibility and resiliency. Note that this product does not include an impact nose, as none is needed to prevent injury to body 331 and objects that it might potentially strike, although a nose could be provided if desired, for example to bias the weight of the body toward the nose for improved performance in flight. Thus incorporating a crush zone may simplify the design of a throwable beverage product and permit a more inexpensive manufacture, as it may reduce the number of parts to manufacture.

The product of FIG. 20B includes molded-in fins. Other types of fins may also be used with a crush zone, including a finned section or reversible finned section as shown in FIGS. 20A and 20C. A crush zone may be altered for appearance, for example by application of a wave to accordion folds as shown in FIG. 20D. Other modifications may be made while preserving the crush zone function, for example by replacing accordion folds with a diamond folds or other shapes. A crush zone might also incorporate texture or bumps in its surface that could serve to catch or trap some of the liquid in the container, adding some weight in that area and providing an interesting visual effect. Note also that a crush zone could also be located in a bottle neck or elsewhere, provided that sufficient mass remains behind the crush zone to provide absorption of a significant portion of the product's mass.

Alternate Fins

Disclosed above are fins that are molded into a bottle body and fins incorporated in a section separate from a bottle body. Other fin configurations are permissible and are now described.

Figure 22A:
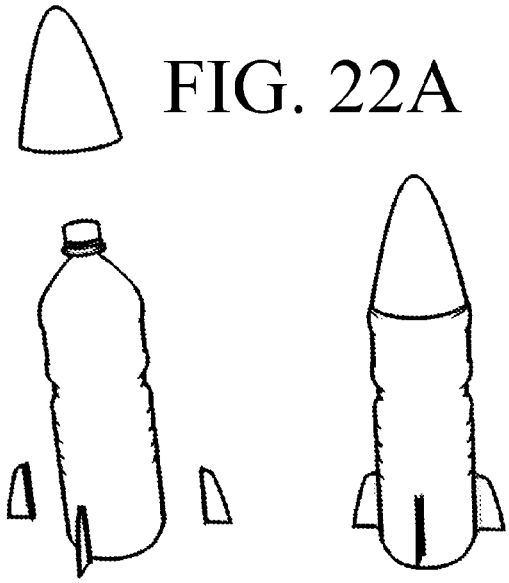
FIG. 22A depicts another type of launchable beverage container product having attachable fins.
Figure 22B:
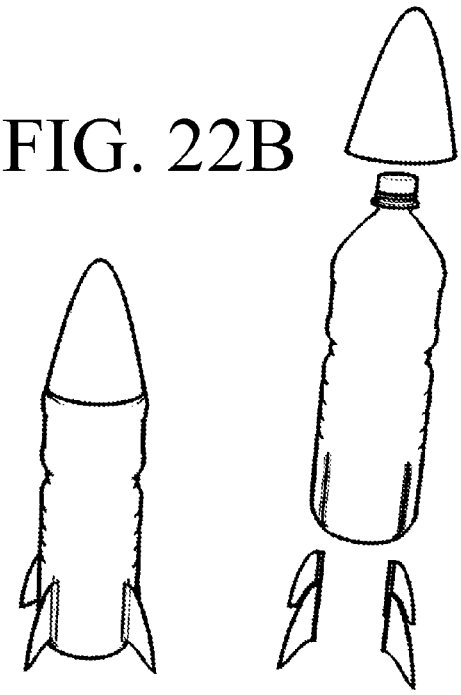
FIG. 22B depicts another type of launchable beverage container product having a slotted body for receiving fins.

First referring to FIG. 22A, fins may be glued, ultrasonically welded, heat welded or otherwise attached to the body of a container, or onto the cap. Fins may also be inserted into slots or channels formed in a bottle body, as in FIG. 22B, which slots/channels may be molded into the body. The reverse is true; the slots and/or channels could be formed in the fins with rails formed in the bottle body. Looking now to FIGS. 22C and 22D, fins 341 might have rails with a cap 340 having channels, and vice versa. Insertable fins can be temporarily or permanently attached through the use of glues, welding or other techniques. Insertable fins may also be reversible; with fins oriented in two possible ways for packaging and throwing.

Figure 23A:
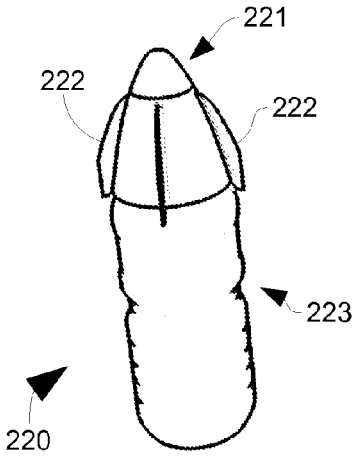
FIG. 23A depicts another type of launchable beverage container product in a shippable condition having a slotted cap for receiving fins, also with a slotted nose.
Figure 23B:
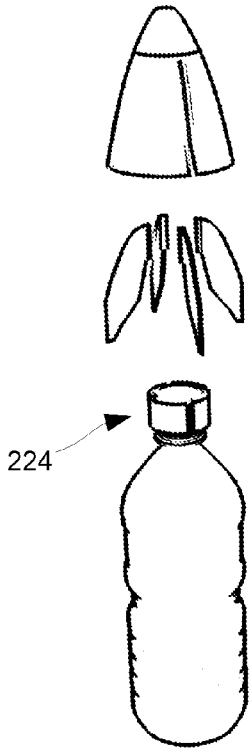
FIG. 23B depicts the product of FIG. 23A after disassembly from a shippable condition.
Figure 23C:
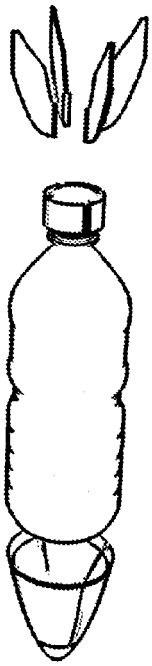
FIG. 23C illustrates the assembly of the product of FIG. 23A into a launchable condition.
Figure 23D:
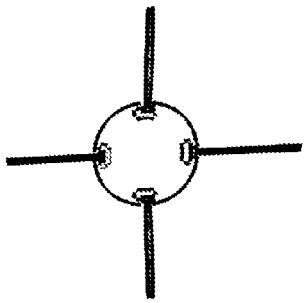
FIG. 23D shows the product of FIG. 23A in a launchable condition as viewed from the side.
Figure 23E:
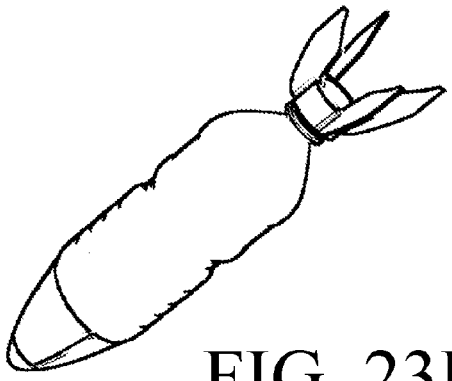
FIG. 23E shows the product of FIG. 23A in a launchable condition as viewed from the tail.

Referring now to FIG. 23A, yet another fin configuration is shown with fins 222 inserted into a nosecone 221 for point-of-sale presentation. After purchase the consumer drinks the beverage by removing the nosecone 221, fins 222 and cap 224, as in FIG. 23B. To prepare the product for throwing the user then relocates the fins 222 to the slots in cap 224 as shown in FIG. 23D, and relocates nosecone to the bottom of bottle 223 as in FIG. 23C. The result is a tossable toy as shown in FIG. 23E.

Looking now to FIG. 24A, another tossable beverage product is shown in its point-of-sale configuration having yet another fin mount. Looking to FIG. 24B, the cap 234 of this product includes hinges and/or rivets to which fins 232 are attached to the cap. After consuming the beverage, the user rotates fins 232 as shown in FIG. 24C and relocates the cone again to the bottom of the bottle, resulting in the tossable configuration shown in FIG. 24D. Hinged fins may be spring loaded, if desired, to default to a retracted or extended position.

All-In-One Version

Figure 25A:
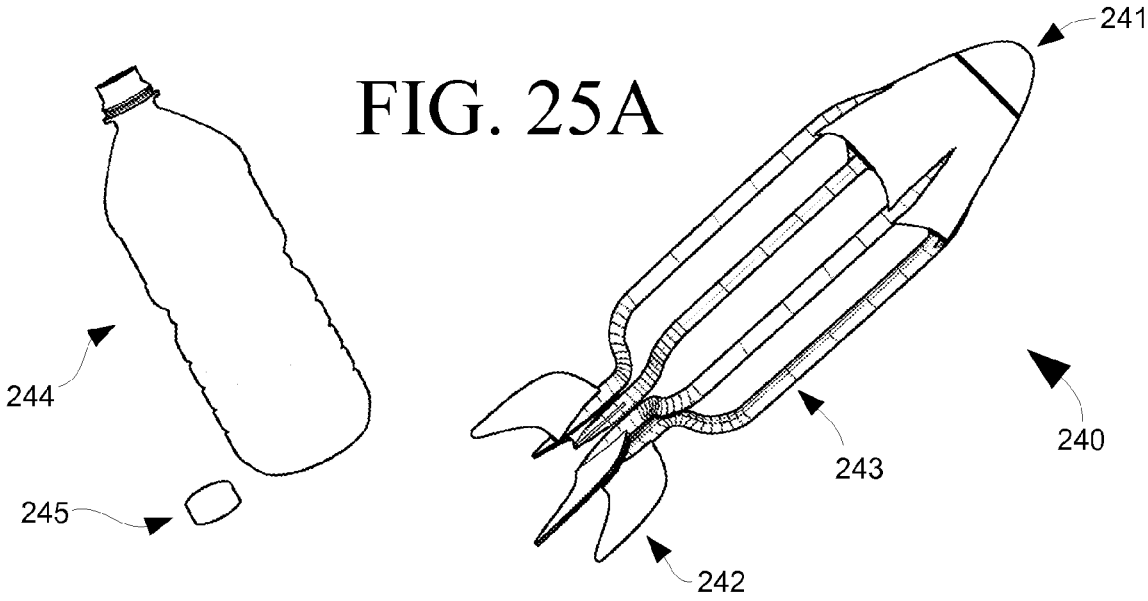
FIG. 25A shows the components of an "all-in-one" type of launchable beverage container product having a piece incorporating a nose and fins.

FIG. 25A depicts another tossable beverage bottle configuration, this time using an ordinary bottle 244 and cap 245 (which might be a personal, disposable drinking water bottle of the sort ordinarily sold in convenience and grocery stores) and an all-in-one part 240 having a nose 241 and fins 242 connected by webs, spider arms or extensions 243. This type of nosecone/fin combination can be molded as a single part or as several parts to be assembled, which may either be provided with the bottle at the time of sale (perhaps even in its tossable position) or provided separately. All-in-one part 240 might be made of plastic, metal, rubber, elastomer or many other materials, and may screw on (for example to a threaded neck), snap on, stretch over, be glued, be welded or otherwise attached to a beverage container.

Figure 25B:
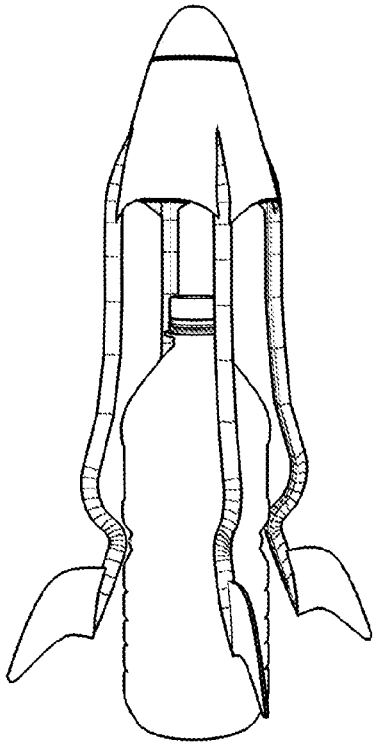
FIG. 25B illustrates the assembly of the all-in-one product of FIG. 25A.
Figure 25C:
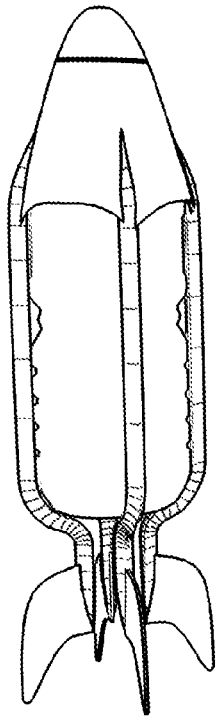
FIG. 25C depicts the all-in-one product of FIG. 25A in a launchable condition.

In this example the bottle 244 is slipped between extensions 243, as shown in FIG. 25B, which arms return to their normal position after insertion as shown in FIG. 25C. In alternative configurations, fins might be made separately and attached to arms, and may extend to any length of the bottle as may be desirable for aesthetic or aerodynamic reasons. The nosecone may be made of the same material as (and even be part of) the arms or extensions, however it may be desirable to fashion an insertable tip made of silicone, rubber or softer plastic to soften impacts. Arms/extensions may be made of resilient plastic, or could be made from wire, by extrusion, etc.

Interior Containment Design

Another configuration of a tossable beverage container is shown in FIG. 26B in its stored state and shown in cutaway in FIG. 26B. Looking at FIG. 26C, this design includes a bottle body 251, a finned section 252 which also doubles as a lit for the body, an open cap or ring 253 and in this example an ball 254, which may be a prize or toy. As this design places the fins inside the container as it is shipped, a user will likely want to rinse or clean off the fin section 252 prior to flight of the product. To configure this product for flight the finned section 252 is inverted and secured with ring 253 back onto body 251 as shown in FIG. 26D, thereby securing the fins to the outside of the body. The resulting tossable toy is depicted in FIG. 26E.

Although in this example bottle body 251 is wide-mouthed, a narrow-mouth version is possible, recognizing that a finned section stored inside the body must pass through its mouth. This version may be more suitable for dry contents or evaporative contents such as unflavored water, thus avoiding a cleaning step.

Nose-Base Bottle

FIGS. 27A-D show an alternate design of a tossable beverage product. This example does not include fins, but rather includes a nose 261 that doubles as a stand for bottle body 260, as seen in FIG. 27A in its drinking configuration. (Note, however, that this example could include fins, if desired.) Looking to FIG. 27B, this bottle body 260 includes a lug 263 insertable into a hole 264 in nose/base 261, wherein the bottle body 260 can be made to stand upright. A tight friction-fit for lug 263 and hole 264 permits the nose/base 261 to be retained with body 260 if it is lifted up, although a loose fit may also be used. To configure the product for shipping or throwing nose/base is applied to the top of base 260, which may be by way of threads, a socket and lug or other attachments, as shown in FIG. 27C. The result is a football-like shape as shown in FIG. 27D; cap 262 may be applied over lug 263 if desired.

A base/nose may be used in many other configurations, including some disclosed herein; no particular shape is necessary. However, in some designs fins, finned sections or bottle bases may provide a way to stand a bottle body and prevent tipping and spillage of any contents. Where such a preventative feature has not been provided in other parts, a nose may be designed to double as a base as in this example.

Although this exemplary product has a smoothed, football shape, other shapes and finishes may be used. Fins or rifling may be molded into a body and/or nose, which may aid in stability or provide a spin to a thrown product.

Now turning to FIG. 28A, a product having a nose/base may be configured in other ways. In this view this product appears how it would at the point of sale, in a compact form. Looking to FIG. 28C, this product includes three parts, which are bottle body 271, nose/base 272 and finned section 273. Finned section 273 includes threads or other means of sealing the opening of bottle body 271 in the configuration of FIG. 28A. To consume the beverage the finned section 273 is uncapped from bottle body 271; the nose/base 272 may remain in the bottom of body 271 to act as a stand during consumption. Note that a cavity is formed in body 272 to receive nose/base 272 in its stand configuration; a lug, spigot or rim might also be used.

To prepare this product for flight the nose/base 272 and finned section 273 are inverted and reapplied to body 271 as shown in FIG. 28D, for example through the use of threads. The result is an "ultimate" ball as shown in FIG. 28E. The nose, fins and body may be of manufacture as described above. This design attempts to provide better flying properties to the product, and therefore has a body that is fat in the middle with a long neck, and nose 272 preferably has substantial weight to improve flying distance.

Powered Football-Type Beverage Product

Figure 29C:
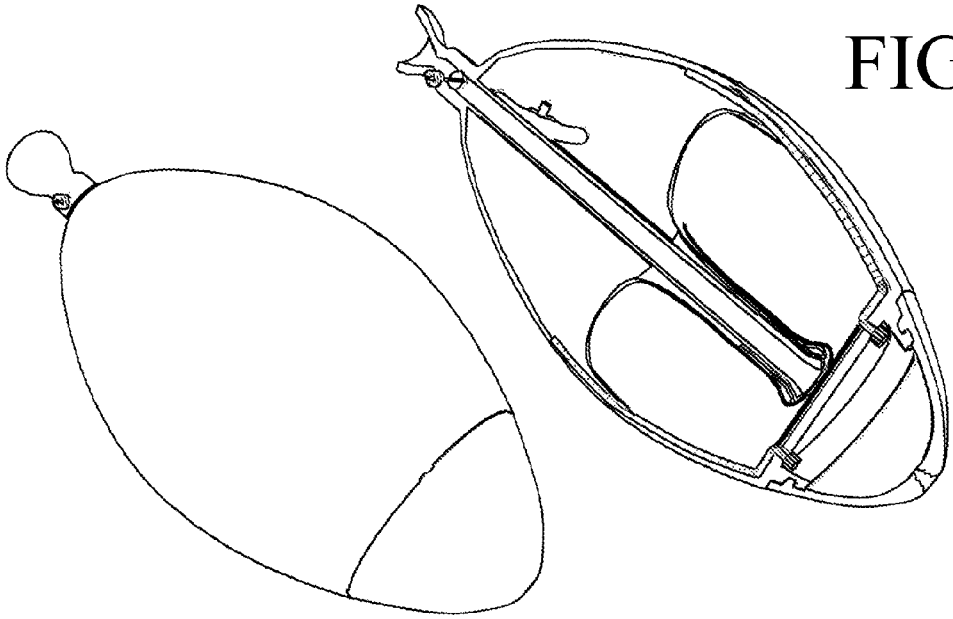
FIG. 29C shows the "football" product of FIG. 29A in an outside and cross-sectional view.
Figure 29D:
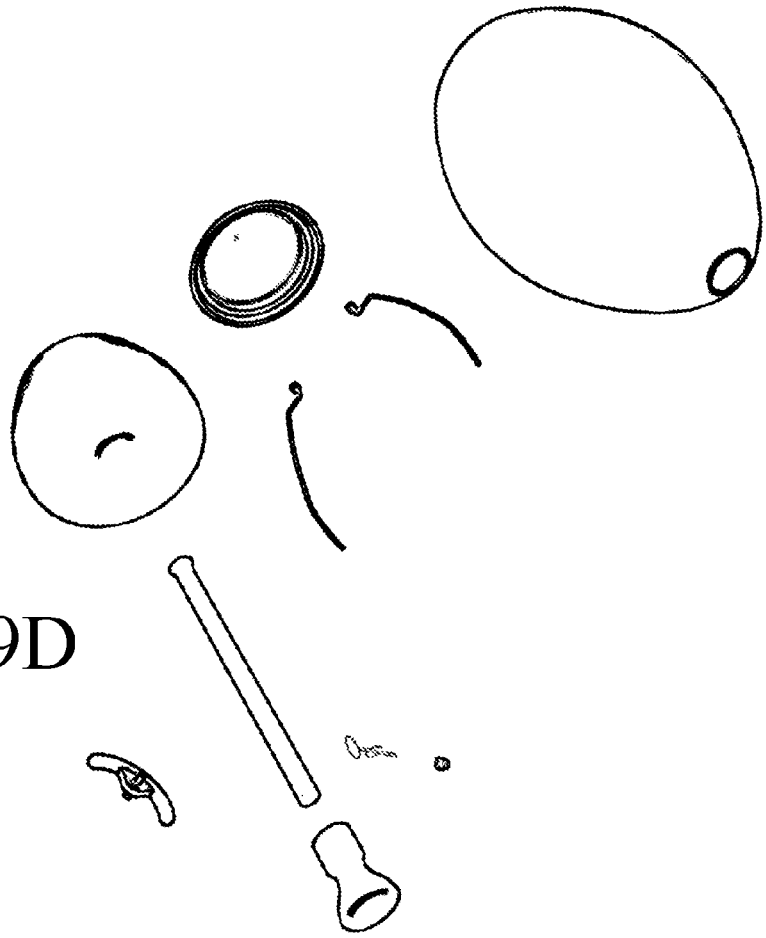
FIG. 29D illustrates the assembly of the components of the "football" product of FIG. 29A.

Now turning to FIG. 29A, a beverage product may be converted into a throwable toy, in this example having a jet providing propulsion for the toy. (Note, however, that this product need not be sold as a beveraged container.) Turning now to FIGS. 29B and 29D, the parts of this product include a finger check valve air pump 280, air ball check valves 281*b* and tubes 281*a*, a water bladder 282, a body with air chamber 283, a water tube 288, a butterfly valve 286, butterfly valve trigger 285 and retainer 284, a butterfly valve spring 287 and a nozzle 289. These parts are assembled as shown in FIG. 29C.

Such a product could be filled with a beverage ready to be consumed, which would be by removal of a cork or seal from the nozzle end, and, using the nozzle like a straw a person would consume the contents. The user could apply pressure to the pump 280 to push the contents out. If desired, the consumer could refill the bladder with more beverage by entry through the nozzle with the butterfly valve in the open position. After consumption of the beverage contained inside, the consumer would then be prepared for launch.

First, the water bladder is filled through the nozzle with the butterfly valve open (the static state of the valve is in an open position, held open by the valve spring.) Water bladder 282 may be a thin plastic membrane and works similar to the way a baby bottle with a liner works. Water bladder 282 is preferably full of fluid with no air inside for launch. The water in bladder 282 may sit forward and toward the outside of the toy, enhancing stable flight and restricting sloshing effects of water contained therein. Once the bladder 282 is full, the operator holds the butterfly valve closed using trigger 285. The operator twists the butterfly valve stem 90 degrees and with his index finger presses down in the upper trigger button (part of trigger 285) thus forcing the lower part of the trigger to block the butterfly valve stem from returning to its normally open position. (It is to be understood that this valving action can be accomplished with other mechanical devices, for example a butterfly valve could be held in a closed position by a cord connected to a valve lever and wrapped around the body, perhaps laid in a channel molded into the body and held in place by the user's index finger.) Continuing to hold the butterfly valve trigger, the consumer repeatedly pumps the pump 280 repeatedly, perhaps with his finger or thumb. The finger check valve air pump forces air through the one way ball check valves 281*b* around bladder 282 through the air tubes 281*a* and into body 283. This pump may have a standard type of check valve to create pressure, but may also use the consumer's pressed finger over a hole as a check valve. As the user's finger is removed from over the hole the pump membrane recovers, refilling the pump with air for the next stroke. This operation is repeated until sufficient pressure is established in body 283. Optionally, a pressure release valve may be incorporated to release overpressure within the tolerance of body 283 and other components, if desired. An overfill valve may be manually operable to release any pressure left in the air chamber, which may provide for ease of refilling bladder 282. A pressure relief valve may be incorporated into one or both of the check valves 281*b*, if desired. It is to be understood that the structures and methods described for this product can be replaced with others to accomplish this pressurized chamber objective. The nose cone air pump may be large, soft and shock absorbing thereby adding safety and durability.

Continuing with the launching operation, the consumer throws the product as if it were a standard football, with the index finger on the trigger and the rest of the hand around the body. At the moment the hand releases the ball (in a normal throwing motion) the index finger will naturally be the last finger touching the ball, and thus the butterfly valve trigger is released at the moment the ball leaves the consumer's hand. The butterfly valve will return to its open position, the pressurized air provides pressure on the water bladder and a pressurized jet of water appears at the nozzle after a short valve-opening delay. This jet provides propulsion and can fly faster and/or farther than under human power only. The processes of injection molding, joining, blow molding and others can be used to manufacture this product.

Living Hinged Tossable Beverage Products

Figures 31A, 31B:
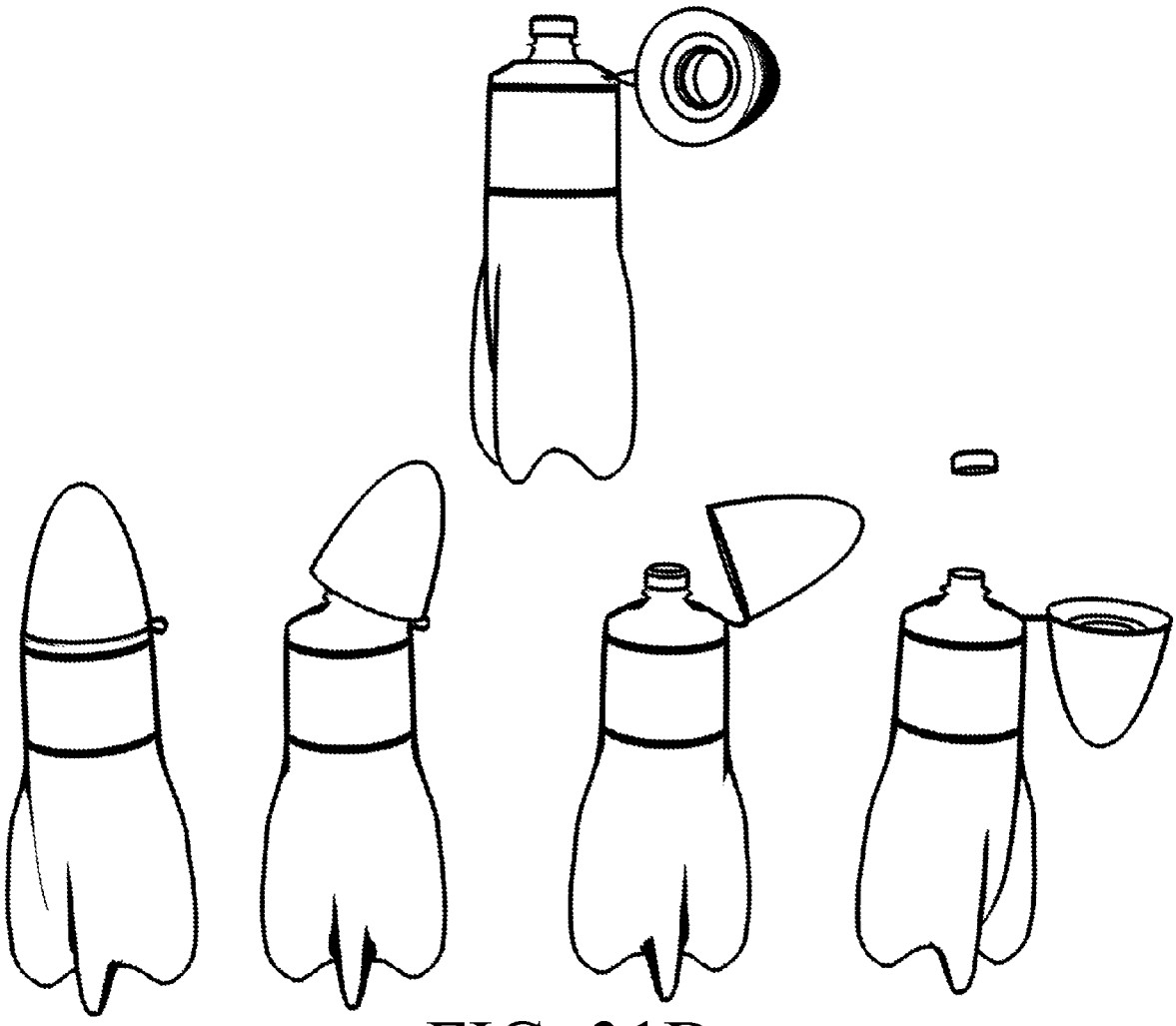
FIG. 31A depicts another type of launchable beverage container product having a nose connected to a body by a living hinge.
FIG. 31B illustrates the disassembly of a nose from the body of the product of 31A into a drinkable configuration.

Turning now to FIG. 30A, a tossable beverage product need not be manufactured with threads or other attachments, but rather may include one or more living hinges 304, for example, connecting a bottle body 300 to nosecone halves 302, fin portions or other components. Through the use of living hinges, the construction of a bottle body and another part may only require one molding step. In this example the nosecone is split into two halves 302, connected by an umbilical 304 that is solid, flexible and engineered to provide a durable connection. Referring now to FIG. 30B, these nose cone halves swing away to reveal the bottle neck and cap, if present. The two halves 302 join by interlocking in two ways, which are a lug on one half fitting into a mouth by friction fit or snapping together. When interlocked, the bottle state is ready for sale, distribution and launch. To consume the bottle contents, the user separates the halves and consumes through the exposed bottle opening. Each half 302 is preferably a shell (i.e. hollow), but could be closed or sealed. Additionally the halves 302 could be filled with water, liquid or some other material to add weight, or could remain air filled if desired. A material such as metal might also be molded in to a nosecone or nosecone halves to provide additional weight. A product as shown in FIG. 31A incorporates a nosecone in one piece, connected through a living hinge. To consume a contained beverage, the nosecone is swung away as shown in FIG. 31B. FIG. 32A shows an alternate beverage product having a pair of swing-away tail sections, with a crush zone as described above. The tail sections swing away via living hinges to reveal a bottle neck, cap and opening, as shown in FIG. 32B.

A living hinge may be made through a molding process, forming both a body and a tail as in FIG. 32A, a nosecone portion as in FIG. 30B, or another part through a single molding step. Rotational molding might be the best method to use to make the product of FIG. 30A, although other methods such as blow-molding, injection molding and other methods or a combination of these might be used. For a rotational mold, several pieces (perhaps 5 or more) would be needed to accomplish the entire bottle body with attached nosecone portions as shown in one step. If a one-piece nosecone were used, perhaps a four-piece mold would be required. Furthermore, if the one- or two-piece nose cone were twisted 90 degrees longitudinally from its final attached position and at right angles longitudinally to the bottle body, the mold form might only be three pieces. Alternatively, an umbilical or living hinge could be fashioned as a separate part and welded or otherwise attached.

Prototype Version

A prototype version of a throwable beverage bottle in the shape of FIG. 1A was made and tested for performance, which information is provided here as an indication of the potential performance of the designs disclosed and/or claimed herein. A prototype was made substantially of the shape shown in FIG. 1B, which was formed using a 0.010 inch think sheet of PET vacuum formed over an SLA rapid prototype form, intending that that the PET prototype would be roughly the same thickness and material of the intended product as well as the same weight and material as an standard 17.9 oz. water bottle (the prototype bottle volume is 18 oz.) The prototype was fitted with a, two part foam rubber self skinning foam nose cone, similar to that used in throwing toys. The prototype bottle weight roughly 4.5 grams including the cap from a standard water bottle. The nose cone weighing in at roughly 6 grams bringing the total together roughly 10 grams (empty). The tester threw several versions of this bottle, with cap and cone, increasing the weight by 5 grams twice. The same tester also threw the bottle body and cap with a 80 gram rubber nose cone as a control. Also the same tester threw an standard (17.9 oz volume) water bottle with cap (empty weight about 4.5 grams) with the 6 gram foam rubber nose cone attached (10 grams) as a control, the tester also threw it unattached. The results were interesting:

| |
|---|
| Aero bottle with foam nose cone; 46 ft, 50 ft, 54 ft. |
| Aero bottle with foam nose cone + 5 grams; 56 ft, 49 ft, 55 ft. |
| Aero bottle with foam nose cone + 10 grams; 62 ft, 61 ft, 63 ft, |
| Aero bottle with rubber 80 gram nose cone; 70 ft, 73 ft, 70 ft. |
| Standard 17.9 oz water bottle with foam nose cone; 21 ft, 17 ft, 19 ft. |
| Standard 17.9 oz water bottle (no nose cone); 11 ft, 14 ft, 12 ft |

From the testing results we determined that as the weight of the nose cone is increased its ability to fly farther was also increased, likely because the additional weight when accelerated by throwing the bottle added momentum to overcome the drag. At a certain point the weight added would theoretically begin to overload a person's ability to accelerate the bottle or throw the bottle efficiently and would begin to decrease the distance. However since the testing goal was to make the bottle as light as possible for safety, and cost reasons, it wasn't at all necessary to find that point. At a total mass of roughly 20 grams for the third prototype bottle thrown, it was determined that 20 grams for a throwing missile (bottle, cap and nose cone) empty, was a good target weight. However as a control the 85 gram prototype bottle was thrown to test distance. The 85 gram bottle only flew about 10 ft farther than the 20 gram prototype bottle. Conversely as an additional control a standard 10 gram water bottle was thrown with the foam nose cone, and it only flew about one third of the distance that the 20 gram prototype bottle did and less than half the distance of the prototype 10 gram bottle. The standard water bottle alone averaged only 12 feet. All bottles were thrown by the same person in the same manner in the same place and distance was measured from the farthest foot forward of the thrower to were the bottle first hit the ground (and not where it finally rolled or bounced to). The test confirms that weight is an important factor in determining the flight distance. However the aerodynamic bottle body design with its aerodynamic & ergonomic body and stabilizing fins has an even greater dramatic effect on the flight distance of the bottle as the test results show, proofing this viability of this concept. All prototype aerodynamic bottles regardless of weight fly straight, stability and predictable in a ballistic arc. The water bottle in each case thrown, flew wildly and ineffectively with the tail erratically moving about or with the whole bottle tumbling end over end.

Now it is to be recognized that the features described above in relation to lauchable, throwable or tossable beverage bottles may be incorporated singly, or any number of these features may be incorporated into a single product, consistent with the principles and purposes disclosed herein. It is therefore to be recognized that the products described herein are merely exemplary and may be modified as taught herein and as will be understood by one of ordinary skill.

What is claimed is:

1. A flying beverage product capable of being processed through a tracked bottling machine, comprising:

a bottle body having a bottom, a wall and an interior, and wherein said body interior is capable of holding a beverage;

a neck incorporated in said bottle body, said neck including an opening through which a beverage may be placed into and removed from said interior;

fins incorporated within the wall of said bottle body, said fins providing for aerodynamic guidance of said body as said body travels through the air in a direction defined by a vector starting from said bottom and to said neck, said fins and said bottle body being fashioned from a single unitary one-piece structure;

a non-finned section formed within the wall of said bottle body between said neck and said fins, whereupon no part of any of said fins is formed within said non-finned section, said non-finned section having a maximum distance such that any two selected points on the interior of said non-finned section are no further apart than that maximum distance, wherein each fin has a point that goes inward of a diameter of the bottom and the non-finned section;

a plurality of valleyed sections incorporated within the wall of said bottle body, each valleyed section being disposed between two of said fins, each of said valleyed sections including a concavity intruding upon the interior of said bottle body, wherein a distance between any two of said concavities is less than the maximum distance of said non-finned section; and a base portion adapted for transport through a track or conveyor.

2. A flying beverage product according to claim 1, wherein said non-finned section is formed in a shape of a cylinder, and further wherein said maximum distance of said non-finned section is a diameter of said non-finned section.

3. A flying beverage product according to claim 1, wherein said base portion is a cylindrical portion formed in the wall of said bottle body, whereby said bottle body may be transported on a track or conveyor without substantial interference between said fins and the track or conveyor.

4. A flying beverage product according to claim 1, wherein a number of said fins incorporated within the wall of said bottle body is four.

5. A flying beverage product according to claim 1, further comprising:

a nose; and a cap portion having a seal fitted to seal said neck and provide enclosure for said interior.

6. A flying beverage product according to claim 5, wherein said nose is adapted to attach to an uncapped bottle.

7. A flying beverage product according to claim 6, wherein said nose is adapted to attach to an uncapped bottle using threads.

8. A flying beverage product according to claim 5, wherein said nose is adapted to attach to a capped bottle.

9. A flying beverage product according to claim 8, wherein said nose is adapted to attach to a capped bottle using an attachment method selected from the group consisting of slip-fit, friction fit and detents.

10. A flying beverage product according to claim 5, wherein said product has a throwing configuration wherein said nose is attached, further wherein in the throwing configuration of said product, said nose has a mass that biases a balance of said product toward the nose.

11. A flying beverage product according to claim 5, wherein said nose is fashioned from a pliable material.

12. A flying beverage product according to claim 5, wherein said nose is fashioned from a stiff material.

13. A flying beverage product according to claim 5, wherein said nose includes said cap portion and said nose, when assembled on said neck, acts as a cap.

14. A flying beverage product according to claim 5, wherein a shape of said nose is selected from the group consisting of pointed, rounded and flattened shapes.

15. A flying beverage product according to claim 5, wherein said nose is adapted to cover a non-threaded portion of said neck of said bottle body when attached to said bottle body.

16. A flying beverage product capable of being processed through a tracked bottling machine, comprising:

a bottle body having a bottom, a wall and an interior, and wherein said body interior is capable of holding a beverage;

a neck incorporated in said bottle body, said neck including an opening through which a beverage may be placed into and removed from said interior;

fins incorporated within the wall of said bottle body, said fins providing for aerodynamic guidance of said body as said body travels through the air in a direction defined by a vector starting from said bottom and to said neck, said fins and said bottle body being fashioned from a single unitary one-piece structure;

a non-finned section formed within the wall of said bottle body between said neck and said fins, whereupon no part of any of said fins is formed within said non-finned section, said non-finned section having a maximum distance such that any two selected points on the interior of said non-finned section are no further apart than that maximum distance, wherein each fin has a point that goes inward of a diameter of the bottom and the non-finned section;

a plurality of valleyed sections incorporated within the wall of said bottle body, each valleyed section being disposed between two of said fins, each of said valleyed sections including a concavity intruding upon the interior of said bottle body, wherein a distance between any two of said concavities is less than the maximum distance of said non-finned section; and a base portion adapted for transport through a track or conveyor; and wherein said body has a stackable configuration whereby two of said bodies may be stacked together, and further wherein in that stacking one of the fins of one of said bottles fits into said valleys formed in the other of said bottles.

17. A flying beverage product according to claim 16, wherein said base portion is a cylindrical portion formed in the wall of said bottle body, whereby said bottle body may be transported on a track or conveyor without substantial interference between said fins and the track or conveyor.

18. A flying beverage product according to claim 16, further comprising:

a nose; and a cap portion having a seal fitted to seal said neck and provide enclosure for said interior.

19. A flying beverage product according to claim 18, wherein said product has a throwing configuration wherein said nose is attached, further wherein in the throwing configuration of said product, said nose has a mass that biases a balance of said product toward the nose.

20. A flying beverage product capable of being processed through a tracked bottling machine, comprising:

a bottle body having a bottom, a wall and an interior, and wherein said body interior is capable of holding a beverage;

a neck incorporated in said bottle body, said neck including an opening through which a beverage may be placed into and removed from said interior;

fins incorporated within the wall of said bottle body, said fins providing for aerodynamic guidance of said body as said body travels through the air in a direction defined by a vector starting from said bottom and to said neck, said fins and said bottle body being fashioned from a single unitary one-piece structure, wherein each fin has a point that goes inward of a diameter of the bottom;

a plurality of valleyed sections incorporated within the wall of said bottle body, each valleyed section being disposed between two of said fins, each of said valleyed sections including a concavity intruding upon the interior of said bottle body, wherein a distance between any two of said concavities is less than a maximum distance of a non-finned section; and a base portion adapted for transport through a track or conveyor.

* * * * *

UNITED STATES PATENT AND TRADEMARK OFFICE

CERTIFICATE OF CORRECTION

PATENT NO. : 8,528,761 B2
APPLICATION NO. : 11/856015
DATED : September 10, 2013
INVENTOR(S) : Justin Curtis Yarro et al.

It is certified that error appears in the above-identified patent and that said Letters Patent is hereby corrected as shown below:

In the Specification

In column 6, line 66 please delete "portion 18" and replace it with --portion 23--.

Signed and Sealed this
Eighteenth Day of February, 2014

Michelle K. Lee

Michelle K. Lee
*Deputy Director of the United States Patent and Trademark Office*